US010136240B2

(12) United States Patent
De Burgh et al.

(10) Patent No.: US 10,136,240 B2
(45) Date of Patent: Nov. 20, 2018

(54) PROCESSING AUDIO DATA TO COMPENSATE FOR PARTIAL HEARING LOSS OR AN ADVERSE HEARING ENVIRONMENT

(71) Applicant: Dolby Laboratories Licensing Corporation, San Francisco, CA (US)

(72) Inventors: Mark David De Burgh, Mount Colah (AU); Tet Fei Yap, Lane Cove North (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 15/568,451

(22) PCT Filed: Apr. 19, 2016

(86) PCT No.: PCT/US2016/028295
§ 371 (c)(1),
(2) Date: Oct. 20, 2017

(87) PCT Pub. No.: WO2016/172111
PCT Pub. Date: Oct. 27, 2016

(65) Prior Publication Data

US 2018/0115850 A1 Apr. 26, 2018

Related U.S. Application Data

(60) Provisional application No. 62/149,946, filed on Apr. 20, 2015.

(51) Int. Cl.
*H04R 5/02* (2006.01)
*H04R 3/00* (2006.01)
(Continued)

(52) U.S. Cl.
CPC ..... *H04S 7/303* (2013.01); *H04R 5/02* (2013.01); *H04S 3/008* (2013.01);
(Continued)

(58) Field of Classification Search
CPC ..... H04S 2400/01; H04S 2400/11; H04S 2400/13; H04S 7/308; H04S 7/303;
(Continued)

(56) References Cited

U.S. PATENT DOCUMENTS 7,974,422 B1 7/2011 Ho
2011/0040395 A1* 2/2011 Kraemer ..... G10L 19/00 700/94
(Continued)

FOREIGN PATENT DOCUMENTS

AU 2013200578 2/2013
CN 103262409 8/2013
(Continued)

OTHER PUBLICATIONS

Pyle, Ken Do you Hear What I hear? Jun. 19, 2014.
(Continued)

*Primary Examiner* — Thang Tran

(57) ABSTRACT

Methods a provided for improving an audio scene for people suffering from hearing loss or for adverse hearing environments. Audio objects may be prioritized. In some implementations, audio objects that correspond to dialog may be assigned to a highest priority level. Other implementations may involve assigning the highest priority to other types of audio objects, such as audio objects that correspond to events. During a process of dynamic range compression, higher-priority objects may be boosted more, or cut less, than lower-priority objects. Some lower-priority audio
(Continued)

objects may fall below the threshold of human hearing, in which case the audio objects may be dropped and not rendered.

15 Claims, 19 Drawing Sheets

(51) Int. Cl.
*H04S 7/00* (2006.01)
*H04S 3/00* (2006.01)

(52) U.S. Cl.
CPC ..... *H04S 2400/01* (2013.01); *H04S 2400/11* (2013.01); *H04S 2400/13* (2013.01)

(58) Field of Classification Search
CPC .. H04S 3/00; H04S 3/008; H04R 5/00; H04R 5/02; H04R 5/04; H04R 3/00; H04R 3/12; G06F 3/165
See application file for complete search history.

(56) References Cited

U.S. PATENT DOCUMENTS

| | | | | |
|---|---|---|---|---|
| 2011/0051940 | A1* | 3/2011 | Ishikawa | H04L 12/40013 381/22 |
| 2012/0237005 | A1 | 9/2012 | Ho | |
| 2013/0243227 | A1 | 9/2013 | Kinsbergen | |
| 2013/0279708 | A1 | 10/2013 | Seefeldt | |
| 2013/0329922 | A1* | 12/2013 | Lemieux | H04S 7/30 381/307 |
| 2014/0119581 | A1* | 5/2014 | Tsingos | H04S 3/008 381/300 |
| 2014/0128940 | A1 | 5/2014 | Strahl | |
| 2014/0133682 | A1* | 5/2014 | Chabanne | H04S 3/002 381/300 |
| 2014/0133683 | A1* | 5/2014 | Robinson | H04S 3/008 381/303 |
| 2015/0223002 | A1* | 8/2015 | Mehta | H04S 7/30 381/303 |
| 2015/0350802 | A1* | 12/2015 | Jo | H04S 5/005 381/1 |
| 2016/0044433 | A1* | 2/2016 | Tsingos | H04S 3/002 381/307 |
| 2016/0064003 | A1* | 3/2016 | Mehta | G10L 19/008 381/23 |
| 2016/0300577 | A1* | 10/2016 | Fersch | H04R 3/12 |

FOREIGN PATENT DOCUMENTS

| | | |
|---|---|---|
| DK | 201170772 | 7/2013 |
| EP | 1185138 | 3/2002 |
| EP | 2690621 | 1/2014 |
| WO | 2007/120453 | 10/2007 |
| WO | 2008/100100 | 8/2008 |
| WO | 2010/006719 | 1/2010 |
| WO | 2010/148169 | 12/2010 |
| WO | 2011/020065 | 2/2011 |
| WO | 2012/122397 | 9/2012 |
| WO | 2013/181272 | 12/2013 |
| WO | 2014/046941 | 3/2014 |

OTHER PUBLICATIONS

Moore, B. et al "A Model for the Prediction of Thresholds, Loudness, and Partial Loudness" J. Audio Eng. Society, vol. 45, No. 4, Apr. 1997, pp. 224-239.

Moore, B. et al "A Revised Model of Loudness Perception Applied to Cochlear Hearing Loss" Hearing Research, vol. 188, Issue 1-2, Feb. 2004, pp. 70-88.

Pulkki, Ville "Compensating Displacement of Amplitude-Panned Virtual Sources" Audio Engineering Society, 22nd International Conference, Synthetic and Entertainment Audio, pp. 186-195, Espoo, Finland, 2002.

* cited by examiner

PROCESSING AUDIO DATA TO COMPENSATE FOR PARTIAL HEARING LOSS OR AN ADVERSE HEARING ENVIRONMENT

CROSS REFERENCE TO RELATED APPLICATIONS

The present invention claims the benefit of United States Provisional Patent Application No. 62/149,946, filed on Apr. 20, 2015, which is hereby incorporated by reference in its entirety.

TECHNICAL FIELD

This disclosure relates to processing audio data. In particular, this disclosure relates to processing audio data corresponding to diffuse or spatially large audio objects.

BACKGROUND

Since the introduction of sound with film in 1927, there has been a steady evolution of technology used to capture the artistic intent of the motion picture sound track and to reproduce this content. In the 1970s Dolby introduced a cost-effective means of encoding and distributing mixes with 3 screen channels and a mono surround channel. Dolby brought digital sound to the cinema during the 1990s with a 5.1 channel format that provides discrete left, center and right screen channels, left and right surround arrays and a subwoofer channel for low-frequency effects. Dolby Surround 7.1, introduced in 2010, increased the number of surround channels by splitting the existing left and right surround channels into four "zones."

Both cinema and home theater audio playback systems are becoming increasingly versatile and complex. Home theater audio playback systems are including increasing numbers of speakers. As the number of channels increases and the loudspeaker layout transitions from a planar two-dimensional (2D) array to a three-dimensional (3D) array including elevation, reproducing sounds in a playback environment is becoming an increasingly complex process.

In addition to the foregoing issues, it can be challenging for listeners with hearing loss to hear all sounds that are reproduced during a movie, a television program, etc. Listeners who have normal hearing can experience similar difficulties in a noisy playback environment. Improved audio processing methods would be desirable.

SUMMARY

Some audio processing methods disclosed herein may involve receiving audio data that may include a plurality of audio objects. The audio objects may include audio signals and associated audio object metadata. The audio object metadata may include audio object position metadata.

Such methods may involve receiving reproduction environment data that may include an indication of a number of reproduction speakers in a reproduction environment. The indication of the number of reproduction speakers in the reproduction environment may be express or implied. For example, the reproduction environment data may indicate that the reproduction environment comprises a Dolby Surround 5.1 configuration, a Dolby Surround 7.1 configuration, a Hamasaki 22.2 surround sound configuration, a headphone configuration, a Dolby Surround 5.1.2 configuration, a Dolby Surround 7.1.2 configuration or a Dolby Atmos configuration. In such implementations, the number of reproduction speakers in a reproduction environment may be implied.

Some such methods may involve determining at least one audio object type from among a list of audio object types that may include dialogue. In some examples, the list of audio object types also may include background music, events and/or ambiance. Such methods may involve making an audio object prioritization based, at least in part, on the audio object type. Making the audio object prioritization may involve assigning a highest priority to audio objects that correspond to dialogue. However, as noted elsewhere herein, in alternative implementations making the audio object prioritization may involve assigning a highest priority to audio objects that correspond to another audio object type. Such methods may involve adjusting audio object levels according to the audio object prioritization and rendering the audio objects into a plurality of speaker feed signals based, at least in part, on the audio object position metadata. Each speaker feed signal may correspond to at least one of the reproduction speakers within the reproduction environment. Some implementations may involve selecting at least one audio object that will not be rendered based, at least in part, on the audio object prioritization.

In some examples, the audio object metadata may include metadata indicating audio object size. Making the audio object prioritization may involve applying a function that reduces a priority of non-dialogue audio objects according to increases in audio object size.

Some such implementations may involve receiving hearing environment data that may include a model of hearing loss, may indicate a deficiency of at least one reproduction speaker and/or may correspond with current environmental noise. Adjusting the audio object levels may be based, at least in part, on the hearing environment data.

The reproduction environment may include an actual or a virtual acoustic space. Accordingly, in some examples, the rendering may involve rendering the audio objects to locations in a virtual acoustic space. In some such examples, the rendering may involve increasing a distance between at least some audio objects in the virtual acoustic space. For example, the virtual acoustic space may include a front area and a back area (e.g., with reference to a virtual listener's head) and the rendering may involve increasing a distance between at least some audio objects in the front area of the virtual acoustic space. In some implementations, the rendering may involve rendering the audio objects according to a plurality of virtual speaker locations within the virtual acoustic space.

In some implementations, the audio object metadata may include audio object prioritization metadata. Adjusting the audio object levels may be based, at least in part, on the audio object prioritization metadata. In some examples, adjusting the audio object levels may involve differentially adjusting levels in frequency bands of corresponding audio signals. Some implementations may involve determining that an audio object has audio signals that include a directional component and a diffuse component and reducing a level of the diffuse component. In some implementations, adjusting the audio object levels may involve dynamic range compression.

In some examples, the audio object metadata may include audio object type metadata. Determining the audio object type may involve evaluating the object type metadata. Alternatively, or additionally, determining the audio object type may involve analyzing the audio signals of audio objects.

Some alternative methods may involve receiving audio data that may include a plurality of audio objects. The audio objects may include audio signals and associated audio object metadata. Such methods may involve extracting one or more features from the audio data and determining an audio object type based, at least in part, on features extracted from the audio signals. In some examples, the one or more features may include spectral flux, loudness, audio object size, entropy-related features, harmonicity features, spectral envelope features, phase features and/or temporal features. The audio object type may be selected from a list of audio object types that includes dialogue. The list of audio object types also may include background music, events and/or ambiance. In some examples, determining the audio object type may involve a machine learning method.

Some such implementations may involve making an audio object prioritization based, at least in part, on the audio object type. The audio object prioritization may determine, at least in part, a gain to be applied during a process of rendering the audio objects into speaker feed signals. Making the audio object prioritization may involve assigning a highest priority to audio objects that correspond to dialogue. However, in alternative implementations making the audio object prioritization may involve assigning a highest priority to audio objects that correspond to another audio object type. Such methods may involve adding audio object prioritization metadata, based on the audio object prioritization, to the audio object metadata.

Such methods may involve determining a confidence score regarding each audio object type determination and applying a weight to each confidence score to produce a weighted confidence score. The weight may correspond to the audio object type determination. Making an audio object prioritization may be based, at least in part, on the weighted confidence score.

Some implementations may involve receiving hearing environment data that may include a model of hearing loss, adjusting audio object levels according to the audio object prioritization and the hearing environment data and rendering the audio objects into a plurality of speaker feed signals based, at least in part, on the audio object position metadata. Each speaker feed signal may correspond to at least one of the reproduction speakers within the reproduction environment.

In some examples, the audio object metadata may include audio object size metadata and the audio object position metadata may indicate locations in a virtual acoustic space. Such methods may involve receiving hearing environment data that may include a model of hearing loss, receiving indications of a plurality of virtual speaker locations within the virtual acoustic space, adjusting audio object levels according to the audio object prioritization and the hearing environment data and rendering the audio objects to the plurality of virtual speaker locations within the virtual acoustic space based, at least in part, on the audio object position metadata and the audio object size metadata.

At least some aspects of the present disclosure may be implemented via apparatus. For example, one or more devices may be capable of performing, at least in part, the methods disclosed herein. In some implementations, an apparatus may include an interface system and a control system. The interface system may include a network interface, an interface between the control system and a memory system, an interface between the control system and another device and/or an external device interface. The control system may include at least one of a general purpose single- or multi-chip processor, a digital signal processor (DSP), an application specific integrated circuit (ASIC), a field programmable gate array (FPGA) or other programmable logic device, discrete gate or transistor logic, or discrete hardware components.

In some examples, the interface system may be capable of receiving audio data that may include a plurality of audio objects. The audio objects may include audio signals and associated audio object metadata. The audio object metadata may include at least audio object position metadata.

The control system may be capable of receiving reproduction environment data that may include an indication of a number of reproduction speakers in a reproduction environment. The control system may be capable of determining at least one audio object type from among a list of audio object types that may include dialogue. The control system may be capable of making an audio object prioritization based, at least in part, on the audio object type, and rendering the audio objects into a plurality of speaker feed signals based, at least in part, on the audio object position metadata. Making the audio object prioritization may involve assigning a highest priority to audio objects that correspond to dialogue. However, in alternative implementations making the audio object prioritization may involve assigning a highest priority to audio objects that correspond to another audio object type. Each speaker feed signal may correspond to at least one of the reproduction speakers within the reproduction environment.

In some examples, the interface system may be capable of receiving hearing environment data. The hearing environment data may include at least one factor such as a model of hearing loss, a deficiency of at least one reproduction speaker and/or current environmental noise. The control system may be capable of adjusting the audio object levels based, at least in part, on the hearing environment data.

In some implementations, the control system may be capable of extracting one or more features from the audio data and determining an audio object type based, at least in part, on features extracted from the audio signals. The audio object type may be selected from a list of audio object types that includes dialogue. In some examples, the list of audio object types also may include background music, events and/or ambiance.

In some implementations, the control system may be capable of making an audio object prioritization based, at least in part, on the audio object type. The audio object prioritization may determine, at least in part, a gain to be applied during a process of rendering the audio objects into speaker feed signals. In some examples, making the audio object prioritization may involve assigning a highest priority to audio objects that correspond to dialogue. However, in alternative implementations making the audio object prioritization may involve assigning a highest priority to audio objects that correspond to another audio object type. In some such examples, the control system may be capable of adding audio object prioritization metadata, based on the audio object prioritization, to the audio object metadata.

According to some examples, the interface system may be capable of receiving hearing environment data that may include a model of hearing loss. The hearing environment data may include environmental noise data, speaker deficiency data and/or hearing loss performance data. In some such examples, the control system may be capable of adjusting audio object levels according to the audio object prioritization and the hearing environment data. In some implementations, the control system may be capable of rendering the audio objects into a plurality of speaker feed signals based, at least in part, on the audio object position metadata. Each speaker feed signal may correspond to at least one of the reproduction speakers within the reproduction environment.

In some examples, the control system may include at least one excitation approximation module capable of determining excitation data. In some such examples, the excitation data may include an excitation indication (also referred to herein as an "excitation") for each of the plurality of audio objects. The excitation may be a function of a distribution of energy along a basilar membrane of a human ear. At least one of the excitations may be based, at least in part, on the hearing environment data. In some implementations, the control system may include a gain solver capable of receiving the excitation data and of determining gain data based, at least in part, on the excitations, the audio object prioritization and the hearing environment data.

Some or all of the methods described herein may be performed by one or more devices according to instructions (e.g., software) stored on non-transitory media. Such non-transitory media may include memory devices such as those described herein, including but not limited to random access memory (RAM) devices, read-only memory (ROM) devices, etc. Accordingly, some innovative aspects of the subject matter described in this disclosure can be implemented in a non-transitory medium having software stored thereon.

For example, the software may include instructions for controlling at least one device for receiving audio data that may include a plurality of audio objects. The audio objects may include audio signals and associated audio object metadata. The audio object metadata may include at least audio object position metadata. In some examples, the software may include instructions for receiving reproduction environment data that may include an indication (direct and/or indirect) of a number of reproduction speakers in a reproduction environment.

In some such examples, the software may include instructions for determining at least one audio object type from among a list of audio object types that may include dialogue and for making an audio object prioritization based, at least in part, on the audio object type. In some implementations, making the audio object prioritization may involve assigning a highest priority to audio objects that correspond to dialogue. However, in alternative implementations making the audio object prioritization may involve assigning a highest priority to audio objects that correspond to another audio object type. In some such examples, the software may include instructions for adjusting audio object levels according to the audio object prioritization and for rendering the audio objects into a plurality of speaker feed signals based, at least in part, on the audio object position metadata. Each speaker feed signal may correspond to at least one of the reproduction speakers within the reproduction environment.

According to some examples, the software may include instructions for controlling the at least one device to receive hearing environment data that may include data corresponding to a model of hearing loss, a deficiency of at least one reproduction speaker and/or current environmental noise. Adjusting the audio object levels may be based, at least in part, on the hearing environment data.

In some implementations, the software may include instructions for extracting one or more features from the audio data and for determining an audio object type based, at least in part, on features extracted from the audio signals. The audio object type may be selected from a list of audio object types that includes dialogue.

In some such examples, the software may include instructions for making an audio object prioritization based, at least in part, on the audio object type. In some implementations, the audio object prioritization may determine, at least in part, a gain to be applied during a process of rendering the audio objects into speaker feed signals. Making the audio object prioritization may, in some examples, involve assigning a highest priority to audio objects that correspond to dialogue. However, in alternative implementations making the audio object prioritization may involve assigning a highest priority to audio objects that correspond to another audio object type. In some such examples, the software may include instructions for adding audio object prioritization metadata, based on the audio object prioritization, to the audio object metadata.

According to some examples, the software may include instructions for controlling the at least one device to receive hearing environment data that may include data corresponding to a model of hearing loss, a deficiency of at least one reproduction speaker and/or current environmental noise. In some such examples, the software may include instructions for adjusting audio object levels according to the audio object prioritization and the hearing environment data and rendering the audio objects into a plurality of speaker feed signals based, at least in part, on the audio object position metadata. Each speaker feed signal may correspond to at least one of the reproduction speakers within the reproduction environment.

Details of one or more implementations of the subject matter described in this specification are set forth in the accompanying drawings and the description below. Other features, aspects, and advantages will become apparent from the description, the drawings, and the claims. Note that the relative dimensions of the following figures may not be drawn to scale.

BRIEF DESCRIPTION OF THE DRAWINGS

Like reference numbers and designations in the various drawings indicate like elements.

DESCRIPTION OF EXAMPLE EMBODIMENTS

The following description is directed to certain implementations for the purposes of describing some innovative aspects of this disclosure, as well as examples of contexts in which these innovative aspects may be implemented. However, the teachings herein can be applied in various different ways. For example, while various implementations are described in terms of particular playback environments, the teachings herein are widely applicable to other known playback environments, as well as playback environments that may be introduced in the future. Moreover, the described implementations may be implemented, at least in part, in various devices and systems as hardware, software, firmware, cloud-based systems, etc. Accordingly, the teachings of this disclosure are not intended to be limited to the implementations shown in the figures and/or described herein, but instead have wide applicability.

As used herein, the term "audio object" refers to audio signals (also referred to herein as "audio object signals") and associated metadata that may be created or "authored" without reference to any particular playback environment. The associated metadata may include audio object position data, audio object gain data, audio object size data, audio object trajectory data, etc. As used herein, the term "rendering" refers to a process of transforming audio objects into speaker feed signals for a playback environment, which may be an actual playback environment or a virtual playback environment. A rendering process may be performed, at least in part, according to the associated metadata and according to playback environment data. The playback environment data may include an indication of a number of speakers in a playback environment and an indication of the location of each speaker within the playback environment.

Figure 1:
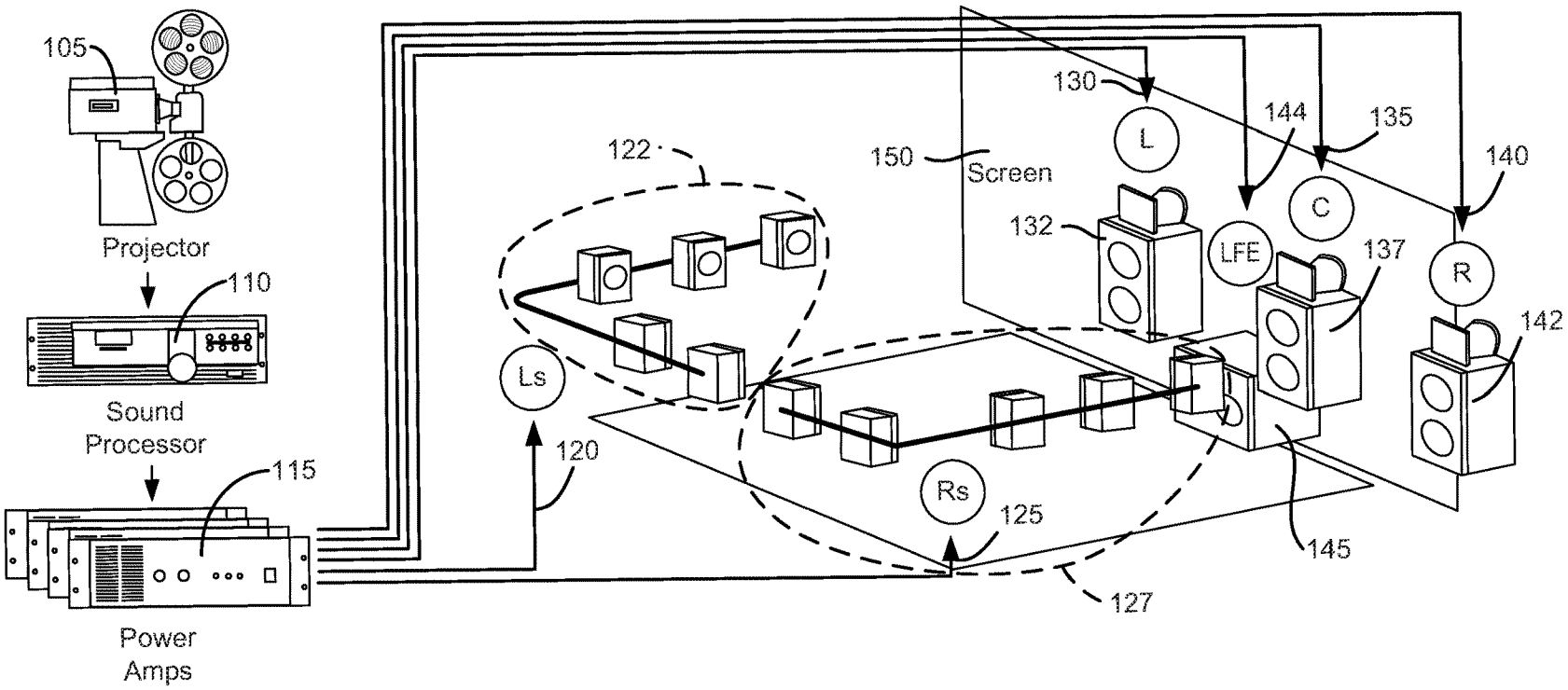
FIG. 1 shows an example of a playback environment having a Dolby Surround 5.1 configuration.

FIG. 1 shows an example of a playback environment having a Dolby Surround 5.1 configuration. In this example, the playback environment is a cinema playback environment. Dolby Surround 5.1 was developed in the 1990s, but this configuration is still widely deployed in home and cinema playback environments. In a cinema playback environment, a projector 105 may be configured to project video images, e.g. for a movie, on a screen 150. Audio data may be synchronized with the video images and processed by the sound processor 110. The power amplifiers 115 may provide speaker feed signals to speakers of the playback environment 100.

The Dolby Surround 5.1 configuration includes a left surround channel 120 for the left surround array 122 and a right surround channel 125 for the right surround array 127. The Dolby Surround 5.1 configuration also includes a left channel 130 for the left speaker array 132, a center channel 135 for the center speaker array 137 and a right channel 140 for the right speaker array 142. In a cinema environment, these channels may be referred to as a left screen channel, a center screen channel and a right screen channel, respectively. A separate low-frequency effects (LFE) channel 144 is provided for the subwoofer 145.

Figure 2:
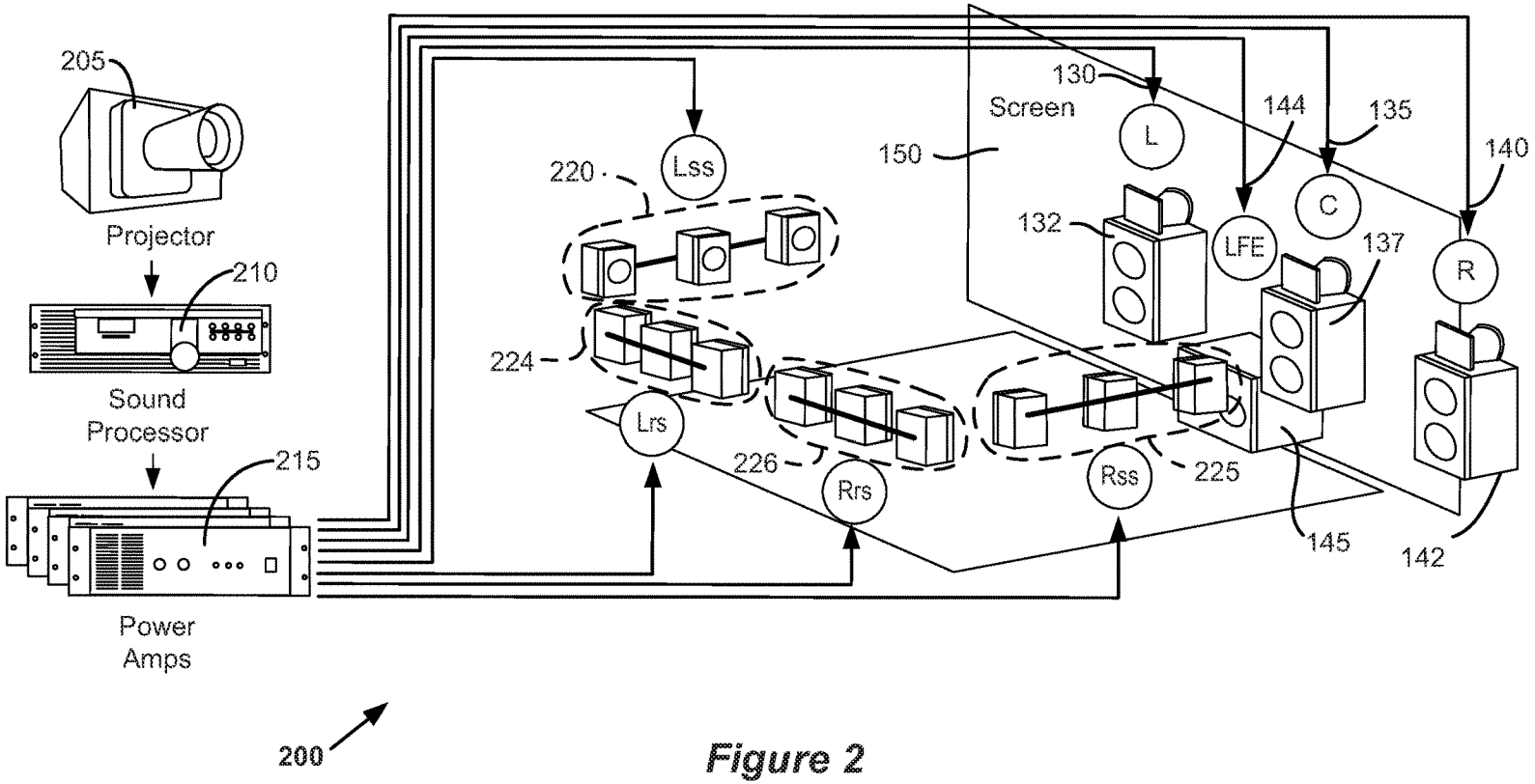
FIG. 2 shows an example of a playback environment having a Dolby Surround 7.1 configuration.

In 2010, Dolby provided enhancements to digital cinema sound by introducing Dolby Surround 7.1. FIG. 2 shows an example of a playback environment having a Dolby Surround 7.1 configuration. A digital projector 205 may be configured to receive digital video data and to project video images on the screen 150. Audio data may be processed by the sound processor 210. The power amplifiers 215 may provide speaker feed signals to speakers of the playback environment 200.

Like Dolby Surround 5.1, the Dolby Surround 7.1 configuration includes a left channel 130 for the left speaker array 132, a center channel 135 for the center speaker array 137, a right channel 140 for the right speaker array 142 and an LFE channel 144 for the subwoofer 145. The Dolby Surround 7.1 configuration includes a left side surround (Lss) array 220 and a right side surround (Rss) array 225, each of which may be driven by a single channel.

However, Dolby Surround 7.1 increases the number of surround channels by splitting the left and right surround channels of Dolby Surround 5.1 into four zones: in addition to the left side surround array 220 and the right side surround array 225, separate channels are included for the left rear surround (Lrs) speakers 224 and the right rear surround (Rrs) speakers 226. Increasing the number of surround zones within the playback environment 200 can significantly improve the localization of sound.

In an effort to create a more immersive environment, some playback environments may be configured with increased numbers of speakers, driven by increased numbers of channels. Moreover, some playback environments may include speakers deployed at various elevations, some of which may be "height speakers" configured to produce sound from an area above a seating area of the playback environment.

Figure 3A:
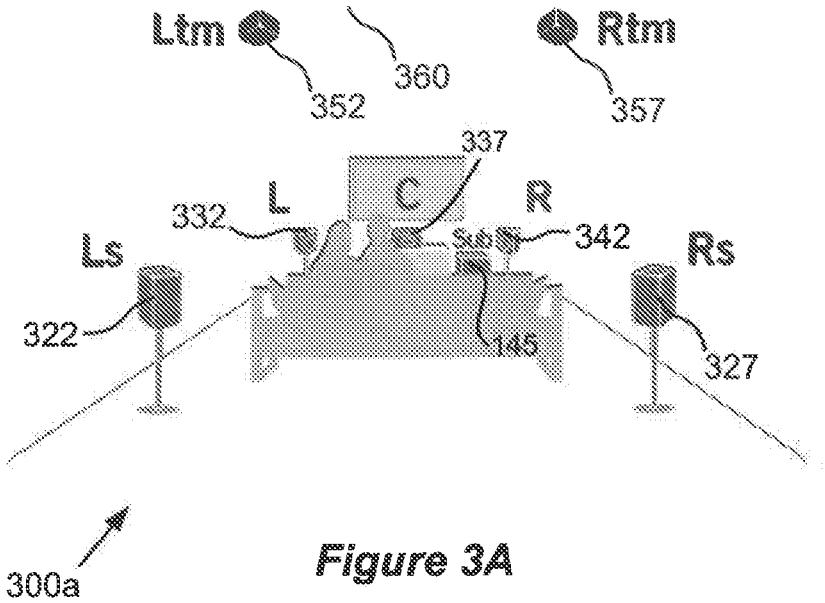
FIGS. 3A and 3B illustrate two examples of home theater playback environments that include height speaker configurations.
Figure 3B:
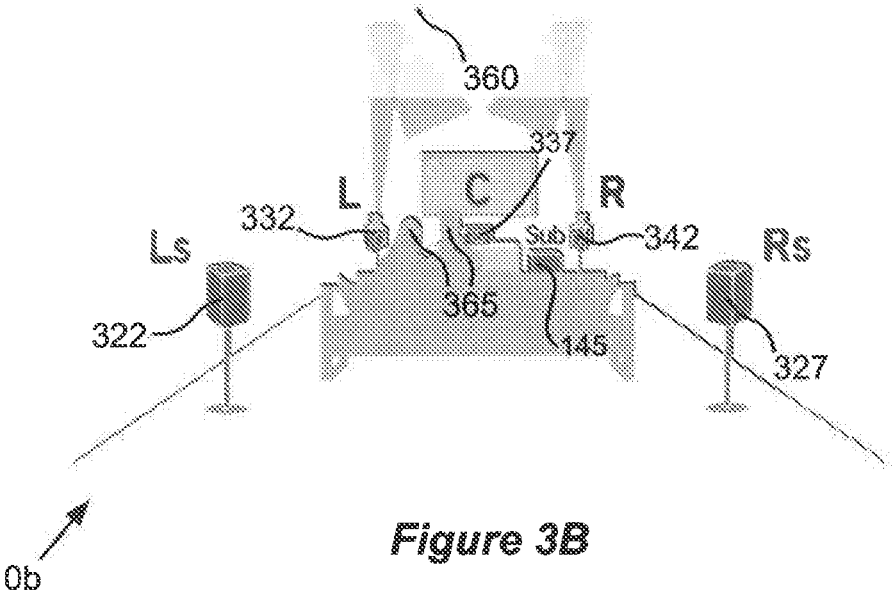

FIGS. 3A and 3B illustrate two examples of home theater playback environments that include height speaker configurations. In these examples, the playback environments 300*a* and 300*b* include the main features of a Dolby Surround 5.1 configuration, including a left surround speaker 322, a right surround speaker 327, a left speaker 332, a right speaker 342, a center speaker 337 and a subwoofer 145. However, the playback environment 300 includes an extension of the Dolby Surround 5.1 configuration for height speakers, which may be referred to as a Dolby Surround 5.1.2 configuration.

FIG. 3A illustrates an example of a playback environment having height speakers mounted on a ceiling 360 of a home theater playback environment. In this example, the playback environment 300*a* includes a height speaker 352 that is in a left top middle (Ltm) position and a height speaker 357 that is in a right top middle (Rtm) position. In the example shown in FIG. 3B, the left speaker 332 and the right speaker 342 are Dolby Elevation speakers that are configured to reflect sound from the ceiling 360. If properly configured, the reflected sound may be perceived by listeners 365 as if the sound source originated from the ceiling 360. However, the number and configuration of speakers is merely provided by way of example. Some current home theater implementations provide for up to 34 speaker positions, and contemplated home theater implementations may allow yet more speaker positions.

Accordingly, the modern trend is to include not only more speakers and more channels, but also to include speakers at differing heights. As the number of channels increases and the speaker layout transitions from \2D to 3D, the tasks of positioning and rendering sounds becomes increasingly difficult.

Accordingly, Dolby has developed various tools, including but not limited to user interfaces, which increase functionality and/or reduce authoring complexity for a 3D audio sound system. Some such tools may be used to create audio objects and/or metadata for audio objects.

Figure 4A:
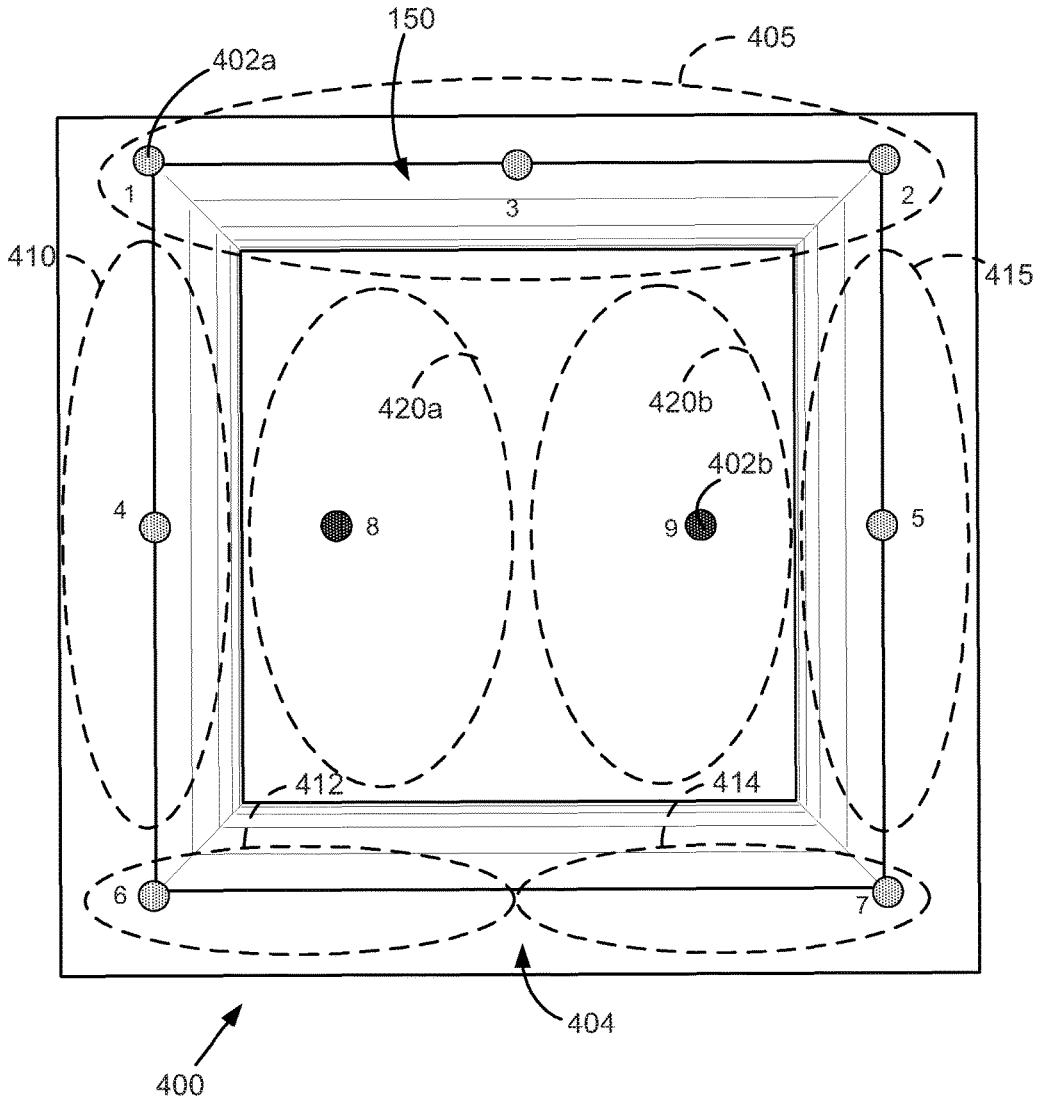
FIG. 4A shows an example of a graphical user interface (GUI) that portrays speaker zones at varying elevations in a virtual playback environment.

FIG. 4A shows an example of a graphical user interface (GUI) that portrays speaker zones at varying elevations in a virtual playback environment. GUI 400 may, for example, be displayed on a display device according to instructions from a logic system, according to signals received from user input devices, etc. Some such devices are described below with reference to FIG. 11.

As used herein with reference to virtual playback environments such as the virtual playback environment 404, the term "speaker zone" generally refers to a logical construct that may or may not have a one-to-one correspondence with a speaker of an actual playback environment. For example, a "speaker zone location" may or may not correspond to a particular speaker location of a cinema playback environment. Instead, the term "speaker zone location" may refer generally to a zone of a virtual playback environment. In some implementations, a speaker zone of a virtual playback environment may correspond to a virtual speaker, e.g., via the use of virtualizing technology such as Dolby Headphone,™ (sometimes referred to as Mobile Surround™), which creates a virtual surround sound environment in real time using a set of two-channel stereo headphones. In GUI 400, there are seven speaker zones 402*a* at a first elevation and two speaker zones 402*b* at a second elevation, making a total of nine speaker zones in the virtual playback environment 404. In this example, speaker zones 1-3 are in the front area 405 of the virtual playback environment 404. The front area 405 may correspond, for example, to an area of a cinema playback environment in which a screen 150 is located, to an area of a home in which a television screen is located, etc.

Here, speaker zone 4 corresponds generally to speakers in the left area 410 and speaker zone 5 corresponds to speakers in the right area 415 of the virtual playback environment 404. Speaker zone 6 corresponds to a left rear area 412 and speaker zone 7 corresponds to a right rear area 414 of the virtual playback environment 404. Speaker zone 8 corresponds to speakers in an upper area 420*a* and speaker zone 9 corresponds to speakers in an upper area 420*b*, which may be a virtual ceiling area. Accordingly, the locations of speaker zones 1-9 that are shown in FIG. 4A may or may not correspond to the locations of speakers of an actual playback environment. Moreover, other implementations may include more or fewer speaker zones and/or elevations.

In various implementations described herein, a user interface such as GUI 400 may be used as part of an authoring tool and/or a rendering tool. In some implementations, the authoring tool and/or rendering tool may be implemented via software stored on one or more non-transitory media. The authoring tool and/or rendering tool may be implemented (at least in part) by hardware, firmware, etc., such as the logic system and other devices described below with reference to FIG. 11. In some authoring implementations, an associated authoring tool may be used to create metadata for associated audio data. The metadata may, for example, include data indicating the position and/or trajectory of an audio object in a three-dimensional space, speaker zone constraint data, etc. The metadata may be created with respect to the speaker zones 402 of the virtual playback environment 404, rather than with respect to a particular speaker layout of an actual playback environment. A rendering tool may receive audio data and associated metadata, and may compute audio gains and speaker feed signals for a playback environment. Such audio gains and speaker feed signals may be computed according to an amplitude panning process, which can create a perception that a sound is coming from a position P in the playback environment. For example, speaker feed signals may be provided to speakers 1 through N of the playback environment according to the following equation:

$$x_i(t)=g_i x(t),\ i=1,\ldots N \qquad \text{(Equation 1)}$$

In Equation 1, $x_i(t)$ represents the speaker feed signal to be applied to speaker $g_i$ represents the gain factor of the corresponding channel, x(t) represents the audio signal and t represents time. The gain factors may be determined, for example, according to the amplitude panning methods described in Section 2, pages 3-4 of V. Pulkki, *Compensating Displacement of Amplitude-Panned Virtual Sources* (Audio Engineering Society (AES) International Conference on Virtual, Synthetic and Entertainment Audio), which is hereby incorporated by reference. In some implementations, the gains may be frequency dependent. In some implementations, a time delay may be introduced by replacing x(t) by $x(t-\Delta t)$.

In some rendering implementations, audio reproduction data created with reference to the speaker zones 402 may be mapped to speaker locations of a wide range of playback environments, which may be in a Dolby Surround 5.1 configuration, a Dolby Surround 7.1 configuration, a Hamasaki 22.2 configuration, or another configuration. For example, referring to FIG. 2, a rendering tool may map audio reproduction data for speaker zones 4 and 5 to the left side surround array 220 and the right side surround array 225 of a playback environment having a Dolby Surround 7.1 configuration. Audio reproduction data for speaker zones 1, 2 and 3 may be mapped to the left screen channel 230, the right screen channel 240 and the center screen channel 235, respectively. Audio reproduction data for speaker zones 6 and 7 may be mapped to the left rear surround speakers 224 and the right rear surround speakers 226.

Figure 4B:
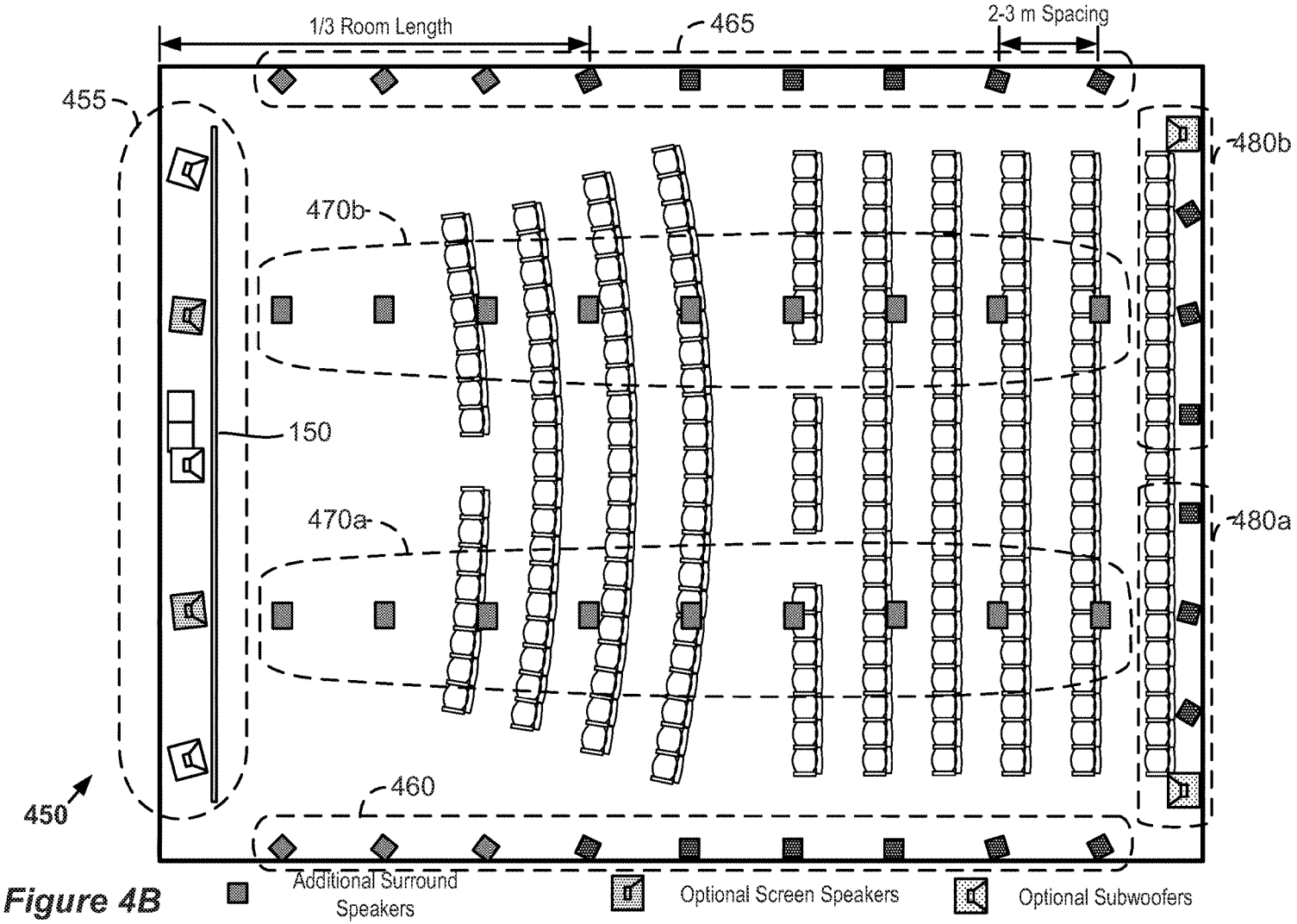
FIG. 4B shows an example of another playback environment.

FIG. 4B shows an example of another playback environment. In some implementations, a rendering tool may map audio reproduction data for speaker zones 1, 2 and 3 to corresponding screen speakers 455 of the playback environment 450. A rendering tool may map audio reproduction data for speaker zones 4 and 5 to the left side surround array 460 and the right side surround array 465 and may map audio reproduction data for speaker zones 8 and 9 to left overhead speakers 470*a* and right overhead speakers 470*b*. Audio reproduction data for speaker zones 6 and 7 may be mapped to left rear surround speakers 480*a* and right rear surround speakers 480*b*.

In some authoring implementations, an authoring tool may be used to create metadata for audio objects. The metadata may indicate the 3D position of the object, rendering constraints, content type (e.g. dialog, effects, etc.) and/or other information. Depending on the implementation, the metadata may include other types of data, such as width data, gain data, trajectory data, etc. Some audio objects may be static, whereas others may move.

Audio objects are rendered according to their associated metadata, which generally includes positional metadata indicating the position of the audio object in a three-dimensional space at a given point in time. When audio objects are monitored or played back in a playback environment, the audio objects are rendered according to the positional metadata using the speakers that are present in the playback environment, rather than being output to a predetermined physical channel, as is the case with traditional, channel-based systems such as Dolby 5.1 and Dolby 7.1.

In addition to positional metadata, other types of metadata may be necessary to produce intended audio effects. For example, in some implementations, the metadata associated with an audio object may indicate audio object size, which may also be referred to as "width." Size metadata may be used to indicate a spatial area or volume occupied by an audio object. A spatially large audio object should be perceived as covering a large spatial area, not merely as a point sound source having a location defined only by the audio object position metadata. In some instances, for example, a large audio object should be perceived as occupying a significant portion of a playback environment, possibly even surrounding the listener.

Spread and apparent source width control are features of some existing surround sound authoring/rendering systems. In this disclosure, the term "spread" refers to distributing the same signal over multiple speakers to blur the sound image. The term "width" (also referred to herein as "size" or "audio object size") refers to decorrelating the output signals to each channel for apparent width control. Width may be an additional scalar value that controls the amount of decorrelation applied to each speaker feed signal.

Figure 5A:
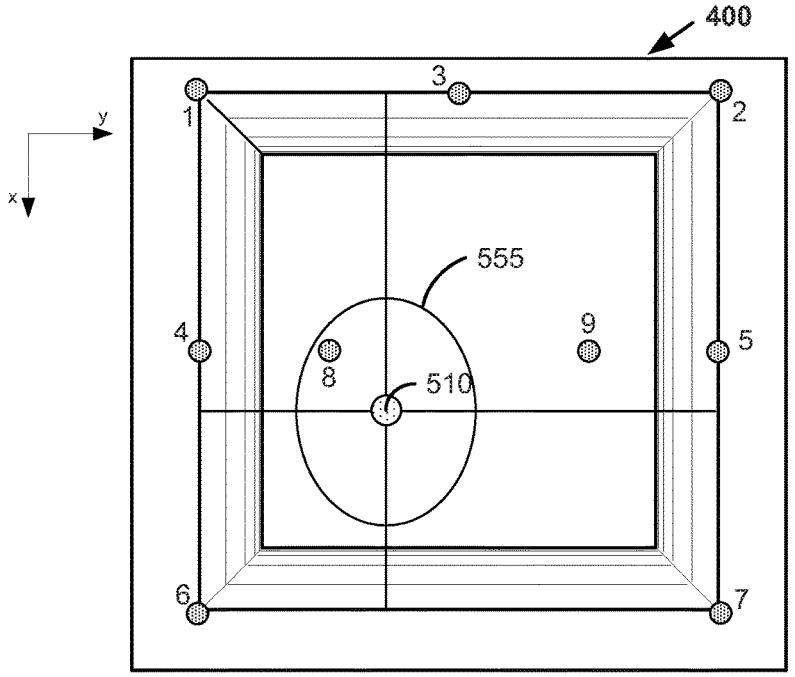
FIG. 5A shows an example of an audio object and associated audio object width in a virtual reproduction environment.

Some implementations described herein provide a 3D axis oriented spread control. One such implementation will now be described with reference to FIGS. 5A and 5B. FIG. 5A shows an example of an audio object and associated audio object width in a virtual reproduction environment. Here, the GUI 400 indicates an ellipsoid 555 extending around the audio object 510, indicating the audio object width or size. The audio object width may be indicated by audio object metadata and/or received according to user input. In this example, the x and y dimensions of the ellipsoid 555 are different, but in other implementations these dimensions may be the same. The z dimensions of the ellipsoid 555 are not shown in FIG. 5A.

Figure 5B:
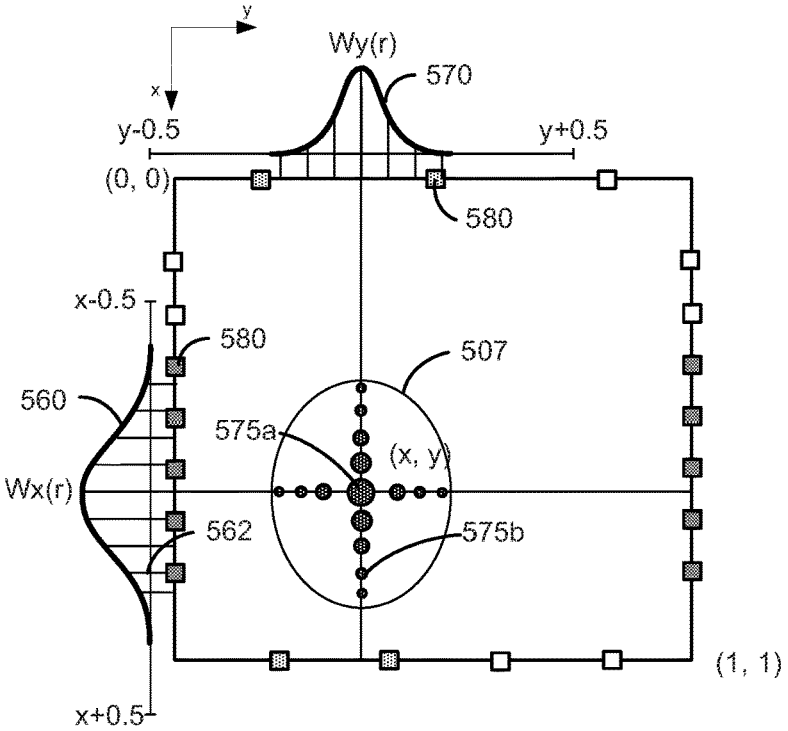
FIG. 5B shows an example of a spread profile corresponding to the audio object width shown in FIG. 5A.

FIG. 5B shows an example of a spread profile corresponding to the audio object width shown in FIG. 5A. Spread may be represented as a three-dimensional vector parameter. In this example, the spread profile 507 can be independently controlled along 3 dimensions, e.g., according to user input. The gains along the x and y axes are represented in FIG. 5B by the respective height of the curves 560 and 1520. The gain for each sample 562 is also indicated by the size of the corresponding circles 575 within the spread profile 507. The responses of the speakers 580 are indicated by gray shading in FIG. 5B.

In some implementations, the spread profile 507 may be implemented by a separable integral for each axis. According to some implementations, a minimum spread value may be set automatically as a function of speaker placement to avoid timbral discrepancies when panning. Alternatively, or additionally, a minimum spread value may be set automatically as a function of the velocity of the panned audio object, such that as audio object velocity increases an object becomes more spread out spatially, similarly to how rapidly moving images in a motion picture appear to blur.

The human hearing system is very sensitive to changes in the correlation or coherence of the signals arriving at both ears, and maps this correlation to a perceived object size attribute if the normalized correlation is smaller than the value of +1. Therefore, in order to create a convincing spatial object size, or spatial diffuseness, a significant proportion of the speaker signals in a playback environment should be mutually independent, or at least be uncorrelated (e.g. independent in terms of first-order cross correlation or covariance). A satisfactory decorrelation process is typically rather complex, normally involving time-variant filters.

A cinema sound track may include hundreds of objects, each with its associated position metadata, size metadata and possibly other spatial metadata. Moreover, a cinema sound system can include hundreds of loudspeakers, which may be individually controlled to provide satisfactory perception of audio object locations and sizes. In a cinema, therefore, hundreds of objects may be reproduced by hundreds of loudspeakers, and the object-to-loudspeaker signal mapping consists of a very large matrix of panning coefficients. When the number of objects is given by M, and the number of loudspeakers is given by N, this matrix has up to M*N elements. This has implications for the reproduction of diffuse or large-size objects. In order to create a convincing spatial object size, or spatial diffuseness, a significant proportion of the N loudspeaker signals should be mutually independent, or at least be uncorrelated. This generally involves the use of many (up to N) independent decorrelation processes, causing a significant processing load for the rendering process. Moreover, the amount of decorrelation may be different for each object, which further complicates the rendering process. A sufficiently complex rendering system, such as a rendering system for a commercial theater, may be capable of providing such decorrelation.

However, less complex rendering systems, such as those intended for home theater systems, may not be capable of providing adequate decorrelation. Some such rendering systems are not capable of providing decorrelation at all. Decorrelation programs that are simple enough to be executed on a home theater system can introduce artifacts. For example, comb-filter artifacts may be introduced if a low-complexity decorrelation process is followed by a downmix process.

Another potential problem is that in some applications, object-based audio is transmitted in the form of a backward-compatible mix (such as Dolby Digital or Dolby Digital Plus), augmented with additional information for retrieving one or more objects from that backward-compatible mix. The backward-compatible mix would normally not have the effect of decorrelation included. In some such systems, the reconstruction of objects may only work reliably if the backward-compatible mix was created using simple panning procedures. The use of decorrelators in such processes can harm the audio object reconstruction process, sometimes severely. In the past, this has meant that one could either choose not to apply decorrelation in the backward-compatible mix, thereby degrading the artistic intent of that mix, or accept degradation in the object reconstruction process.

In order to address such potential problems, some implementations described herein involve identifying diffuse or spatially large audio objects for special processing. Such methods and devices may be particularly suitable for audio data to be rendered in a home theater. However, these methods and devices are not limited to home theater use, but instead have broad applicability.

Due to their spatially diffuse nature, objects with a large size are not perceived as point sources with a compact and concise location. Therefore, multiple speakers are used to reproduce such spatially diffuse objects. However, the exact locations of the speakers in the playback environment that are used to reproduce large audio objects are less critical than the locations of speakers use to reproduce compact, small-sized audio objects. Accordingly, a high-quality reproduction of large audio objects is possible without prior knowledge about the actual playback speaker configuration used to eventually render decorrelated large audio object signals to actual speakers of the playback environment. Consequently, decorrelation processes for large audio objects can be performed "upstream," before the process of rendering audio data for reproduction in a playback environment, such as a home theater system, for listeners. In some examples, decorrelation processes for large audio objects are performed prior to encoding audio data for transmission to such playback environments.

Such implementations do not require the renderer of a playback environment to be capable of high-complexity decorrelation, thereby allowing for rendering processes that may be relatively simpler, more efficient and cheaper. Backward-compatible downmixes may include the effect of decorrelation to maintain the best possible artistic intent, without the need to reconstruct the object for rendering-side decorrelation. High-quality decorrelators can be applied to large audio objects upstream of a final rendering process, e.g., during an authoring or post-production process in a sound studio. Such decorrelators may be robust with regard to downmixing and/or other downstream audio processing.

Figure 5C:
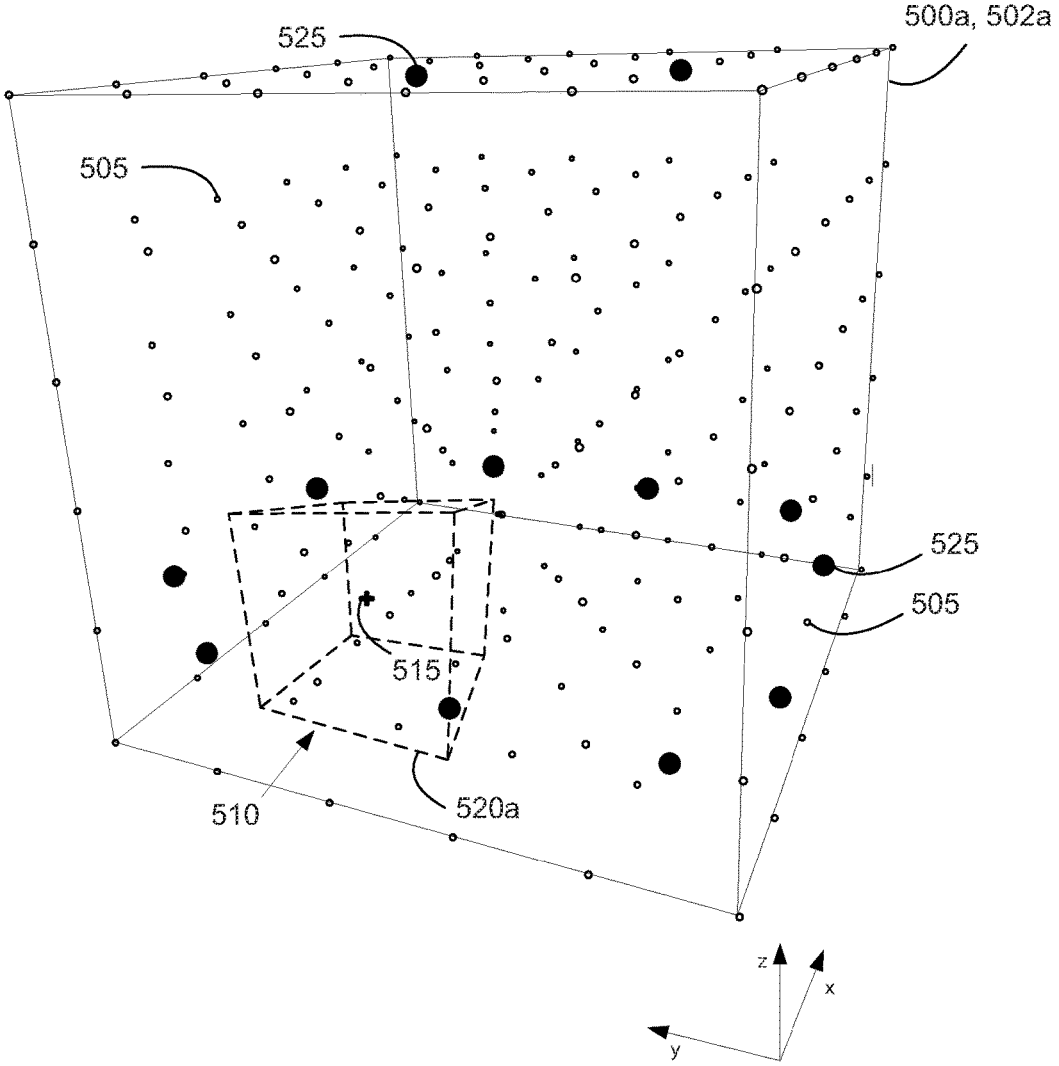
FIG. 5C shows an example of virtual source locations relative to a playback environment.

Some examples of rendering audio object signals to virtual speaker locations will now be described with reference to FIGS. 5C and 5D. FIG. 5C shows an example of virtual source locations relative to a playback environment. The playback environment may be an actual playback environment or a virtual playback environment. The virtual source locations 505 and the speaker locations 525 are merely examples. However, in this example the playback environment is a virtual playback environment and the speaker locations 525 correspond to virtual speaker locations.

In some implementations, the virtual source locations 505 may be spaced uniformly in all directions. In the example shown in FIG. 5A, the virtual source locations 505 are spaced uniformly along x, y and z axes. The virtual source locations 505 may form a rectangular grid of $N_x$ by $N_y$ by $N_z$ virtual source locations 505. In some implementations, the value of N may be in the range of 5 to 100. The value of N may depend, at least in part, on the number of speakers in the playback environment (or expected to be in the playback environment): it may be desirable to include two or more virtual source locations 505 between each speaker location.

However, in alternative implementations, the virtual source locations 505 may be spaced differently. For example, in some implementations the virtual source locations 505 may have a first uniform spacing along the x and y axes and a second uniform spacing along the z axis. In other implementations, the virtual source locations 505 may be spaced non-uniformly.

In this example, the audio object volume 520*a* corresponds to the size of the audio object. The audio object 510 may be rendered according to the virtual source locations 505 enclosed by the audio object volume 520*a*. In the example shown in FIG. 5A, the audio object volume 520*a* occupies part, but not all, of the playback environment 500*a*. Larger audio objects may occupy more of (or all of) the playback environment 500*a*. In some examples, if the audio object 510 corresponds to a point source, the audio object 510 may have a size of zero and the audio object volume 520*a* may be set to zero.

According to some such implementations, an authoring tool may link audio object size with decorrelation by indicating (e.g., via a decorrelation flag included in associated metadata) that decorrelation should be turned on when the audio object size is greater than or equal to a size threshold value and that decorrelation should be turned off if the audio object size is below the size threshold value. In some implementations, decorrelation may be controlled (e.g., increased, decreased or disabled) according to user input regarding the size threshold value and/or other input values.

In this example, the virtual source locations 505 are defined within a virtual source volume 502. In some implementations, the virtual source volume may correspond with a volume within which audio objects can move. In the example shown in FIG. 5A, the playback environment 500*a* and the virtual source volume 502*a* are co-extensive, such that each of the virtual source locations 505 corresponds to a location within the playback environment 500*a*. However, in alternative implementations, the playback environment 500*a* and the virtual source volume 502 may not be co-extensive.

For example, at least some of the virtual source locations 505 may correspond to locations outside of the playback environment. FIG. 5B shows an alternative example of virtual source locations relative to a playback environment. In this example, the virtual source volume 502*b* extends outside of the playback environment 500*b*. Some of the virtual source locations 505 within the audio object volume 520*b* are located inside of the playback environment 500*b* and other virtual source locations 505 within the audio object volume 520*b* are located outside of the playback environment 500*b*.

In other implementations, the virtual source locations 505 may have a first uniform spacing along x and y axes and a second uniform spacing along a z axis. The virtual source locations 505 may form a rectangular grid of $N_x$ by $N_y$ by $M_z$, virtual source locations 505. For example, in some implementations there may be fewer virtual source locations 505 along the z axis than along the x or y axes. In some such implementations, the value of N may be in the range of 10 to 100, whereas the value of M may be in the range of 5 to 10.

Some implementations involve computing gain values for each of the virtual source locations 505 within an audio object volume 520. In some implementations, gain values for each channel of a plurality of output channels of a playback environment (which may be an actual playback environment or a virtual playback environment) will be computed for each of the virtual source locations 505 within an audio object volume 520. In some implementations, the gain values may be computed by applying a vector-based amplitude panning ("VBAP") algorithm, a pairwise panning algorithm or a similar algorithm to compute gain values for point sources located at each of the virtual source locations 505 within an audio object volume 520. In other implementations, a separable algorithm, to compute gain values for point sources located at each of the virtual source locations 505 within an audio object volume 520. As used herein, a "separable" algorithm is one for which the gain of a given speaker can be expressed as a product of multiple factors (e.g., three factors), each of which depends only on one of the coordinates of the virtual source location 505. Examples include algorithms implemented in various existing mixing console panners, including but not limited to the Pro Tools™ software and panners implemented in digital film consoles provided by AMS Neve.

In some implementations, a virtual acoustic space may be represented as an approximation to the sound field at a point (or on a sphere). Some such a implementations may involve projecting onto a set of orthogonal basis functions on a sphere. In some such representations, which are based on Ambisonics, the basis functions are spherical harmonics. In such a format, a source at azimuth angle θ and an elevation φ will be panned with different gains onto the first 4 W, X, Y and Z basis functions. In some such examples, the gains may be given by the following equations:

$$W = S \cdot \frac{1}{\sqrt{2}}$$

$$X = S \cdot \cos\theta\cos\phi$$

$$Y = S \cdot \sin\theta\cos\phi$$

$$Z = S \cdot \sin\phi$$

Figure 5D:
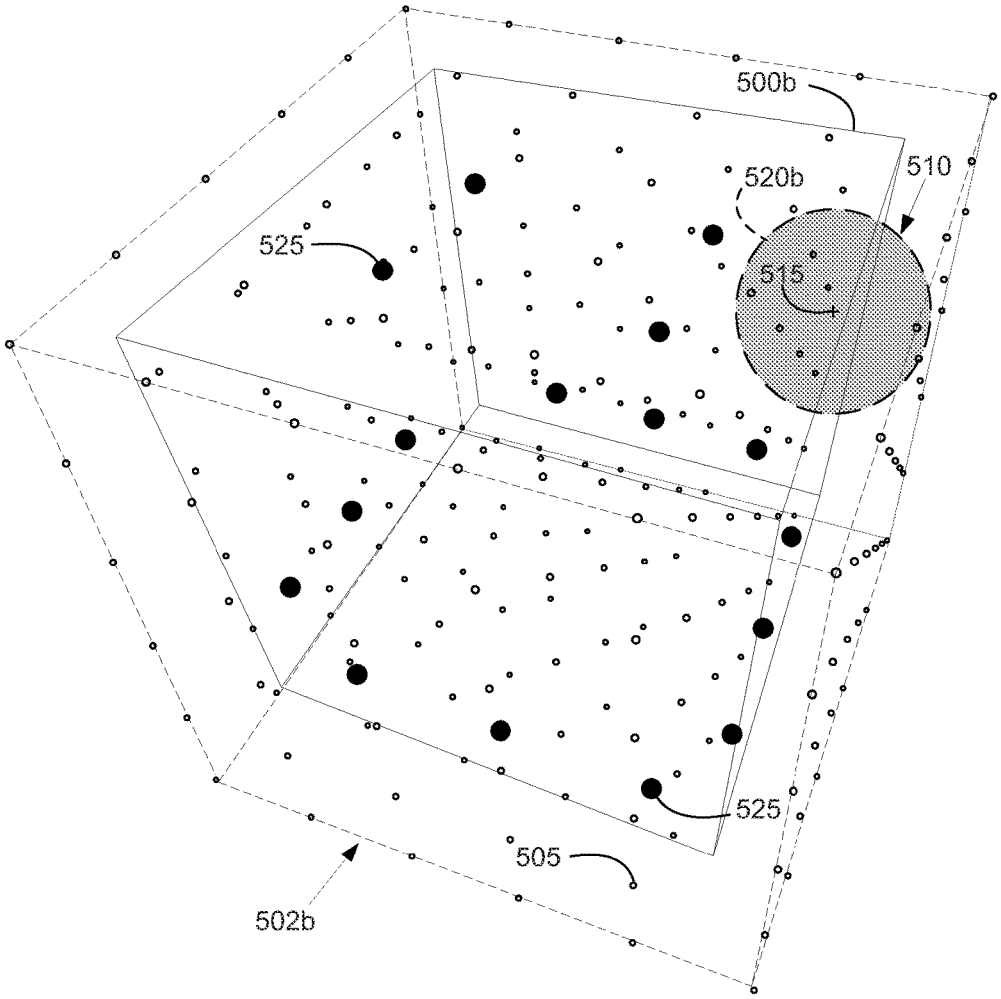
FIG. 5D shows an alternative example of virtual source locations relative to a playback environment.
Figure 5E:
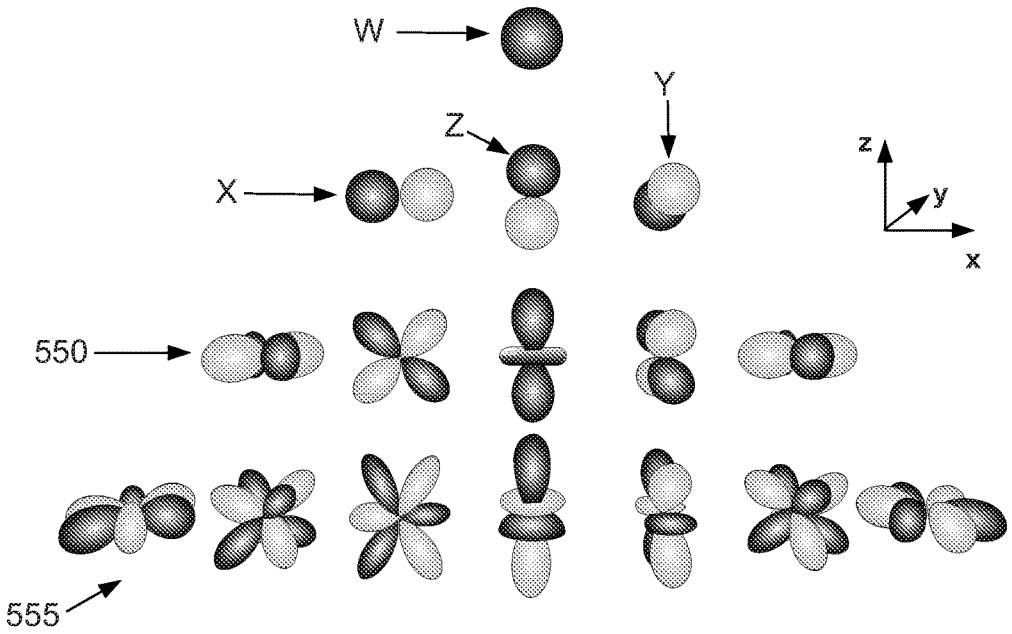
FIG. 5E shows examples of W, X, Y and Z basis functions.

FIG. 5E shows examples of W, X, Y and Z basis functions. In this example, the omnidirectional component W is independent of angle. The X, Y and Z components may, for example, correspond to microphones with a dipole response, oriented along the X, Y and Z axes. Higher order components, examples of which are shown in rows 550 and 555 of FIG. 5E, can be used to achieve greater spatial accuracy.

Mathematically, the spherical harmonics are solutions of Laplace's equation in 3 dimensions, and are found to have the form $Y_l^m(\theta,\varphi)=Ne^{imp}P_l^m(\cos\theta)$, in which m represents an integer, N represents a normalization constant and t represents a Legendre polynomial. However, in some implementations the above functions may be represented in rectangular coordinates rather than the spherical coordinates used above.

Figure 6A:
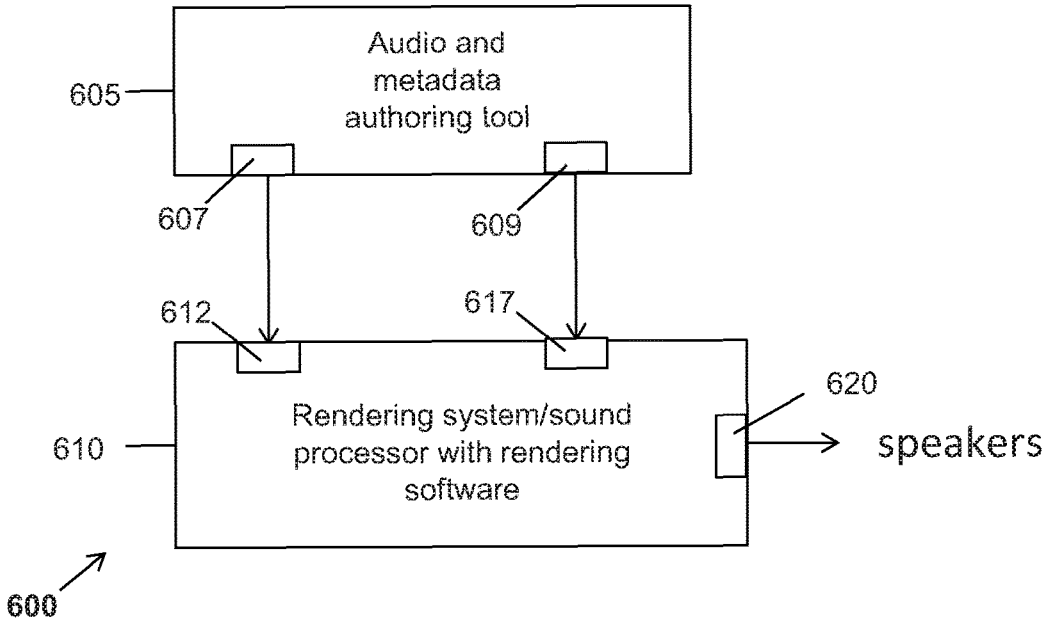
FIG. 6A is a block diagram that represents some components that may be used for audio content creation.

FIG. 6A is a block diagram that represents some components that may be used for audio content creation. The system 600 may, for example, be used for audio content creation in mixing studios and/or dubbing stages. In this example, the system 600 includes an audio and metadata authoring tool 605 and a rendering tool 610. In this implementation, the audio and metadata authoring tool 605 and the rendering tool 610 include audio connect interfaces 607 and 612, respectively, which may be configured for communication via AES/EBU, MADI, analog, etc. The audio and metadata authoring tool 605 and the rendering tool 610 include network interfaces 609 and 617, respectively, which may be configured to send and receive metadata via TCP/IP or any other suitable protocol. The interface 620 is configured to output audio data to speakers.

The system 600 may, for example, include an existing authoring system, such as a Pro Tools™ system, running a metadata creation tool (i.e., a panner as described herein) as a plugin. The panner could also run on a standalone system (e.g. a PC or a mixing console) connected to the rendering tool 610, or could run on the same physical device as the rendering tool 610. In the latter case, the panner and renderer could use a local connection e.g., through shared memory. The panner GUI could also be remoted on a tablet device, a laptop, etc. The rendering tool 610 may comprise a rendering system that includes a sound processor capable of executing rendering software. The rendering system may include, for example, a personal computer, a laptop, etc., that includes interfaces for audio input/output and an appropriate logic system.

Figure 6B:
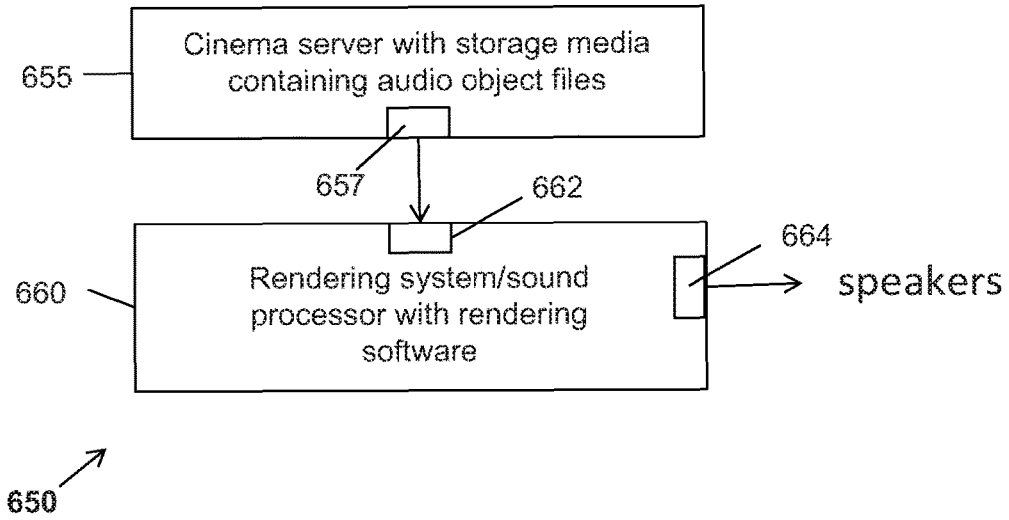
FIG. 6B is a block diagram that represents some components that may be used for audio playback in a reproduction environment (e.g., a movie theater).

FIG. 6B is a block diagram that represents some components that may be used for audio playback in a reproduction environment (e.g., a movie theater). The system 650 includes a cinema server 655 and a rendering system 660 in this example. The cinema server 655 and the rendering system 660 include network interfaces 657 and 662, respectively, which may be configured to send and receive audio objects via TCP/IP or any other suitable protocol. The interface 664 may be configured to output audio data to speakers.

As noted above, it can be challenging for listeners with hearing loss to hear all sounds that are reproduced during a movie, a television program, etc. For example, listeners with hearing loss may perceive an audio scene (the aggregate of audio objects being reproduced at a particular time) as seeming to be too "cluttered," in other words having too many audio objects. It may be difficult for listeners with hearing loss to understand dialogue, for example. Listeners who have normal hearing can experience similar difficulties in a noisy playback environment.

Some implementations disclosed herein provide methods for improving an audio scene for people suffering from hearing loss or for adverse hearing environments. Some such implementations are based, at least in part, on the observation that some audio objects may be more important to an audio scene than others. Accordingly, in some such implementations audio objects may be prioritized. For example, in some implementations, audio objects that correspond to dialogue may be assigned the highest priority. Other implementations may involve assigning the highest priority to other types of audio objects, such as audio objects that correspond to events. In some examples, during a process of dynamic range compression, higher-priority audio objects may be boosted more, or cut less, than lower-priority audio objects. Lower-priority audio objects may fall completely below the threshold of hearing, in which case they may be dropped and not rendered.

Figure 7:
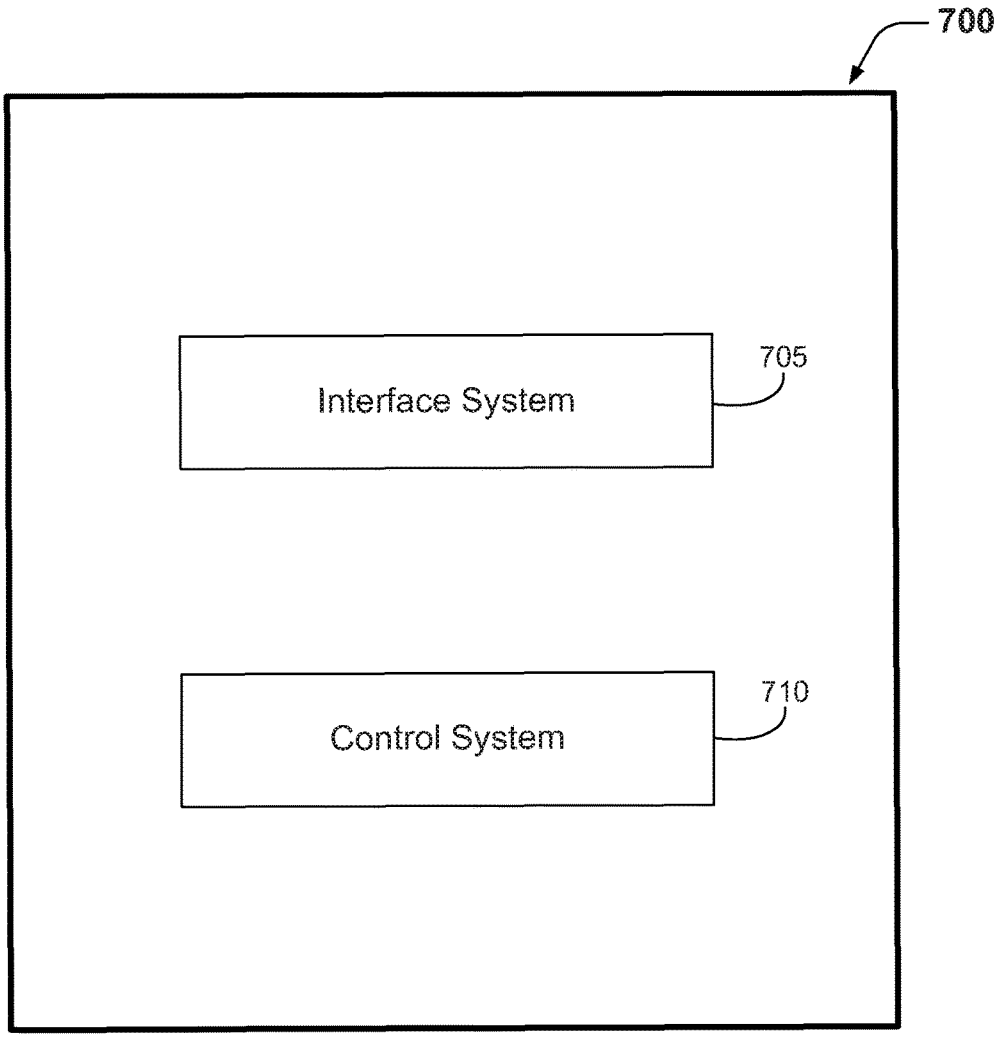
FIG. 7 is a block diagram that shows examples of components of an apparatus capable of implementing various aspects of this disclosure.

FIG. 7 is a block diagram that shows examples of components of an apparatus capable of implementing various aspects of this disclosure. The apparatus 700 may be implemented via hardware, via software stored on non-transitory media, via firmware and/or by combinations thereof. The types and numbers of components shown in FIG. 7 are merely shown by way of example. Alternative implementations may include more, fewer and/or different components. The apparatus 700 may, for example, be an instance of an apparatus such as those described below with reference to FIGS. 8-13. In some examples, the apparatus 700 may be a component of another device or of another system. For example, the apparatus 700 may be a component of an authoring system such as the system 600 described above or a component of a system used for audio playback in a reproduction environment (e.g., a movie theater, a home theater system, etc.) such as the system 650 described above.

In this example, the apparatus 700 includes an interface system 705 and a control system 710. The interface system 705 may include one or more network interfaces, one or more interfaces between the control system 710 and a memory system and/or one or more an external device interfaces (such as one or more universal serial bus (USB) interfaces). The control system 710 may, for example, include a general purpose single- or multi-chip processor, a digital signal processor (DSP), an application specific integrated circuit (ASIC), a field programmable gate array (FPGA) or other programmable logic device, discrete gate or transistor logic, and/or discrete hardware components. In some implementations, the control system 710 may be capable of authoring system functionality and/or audio playback functionality.

Figure 8:
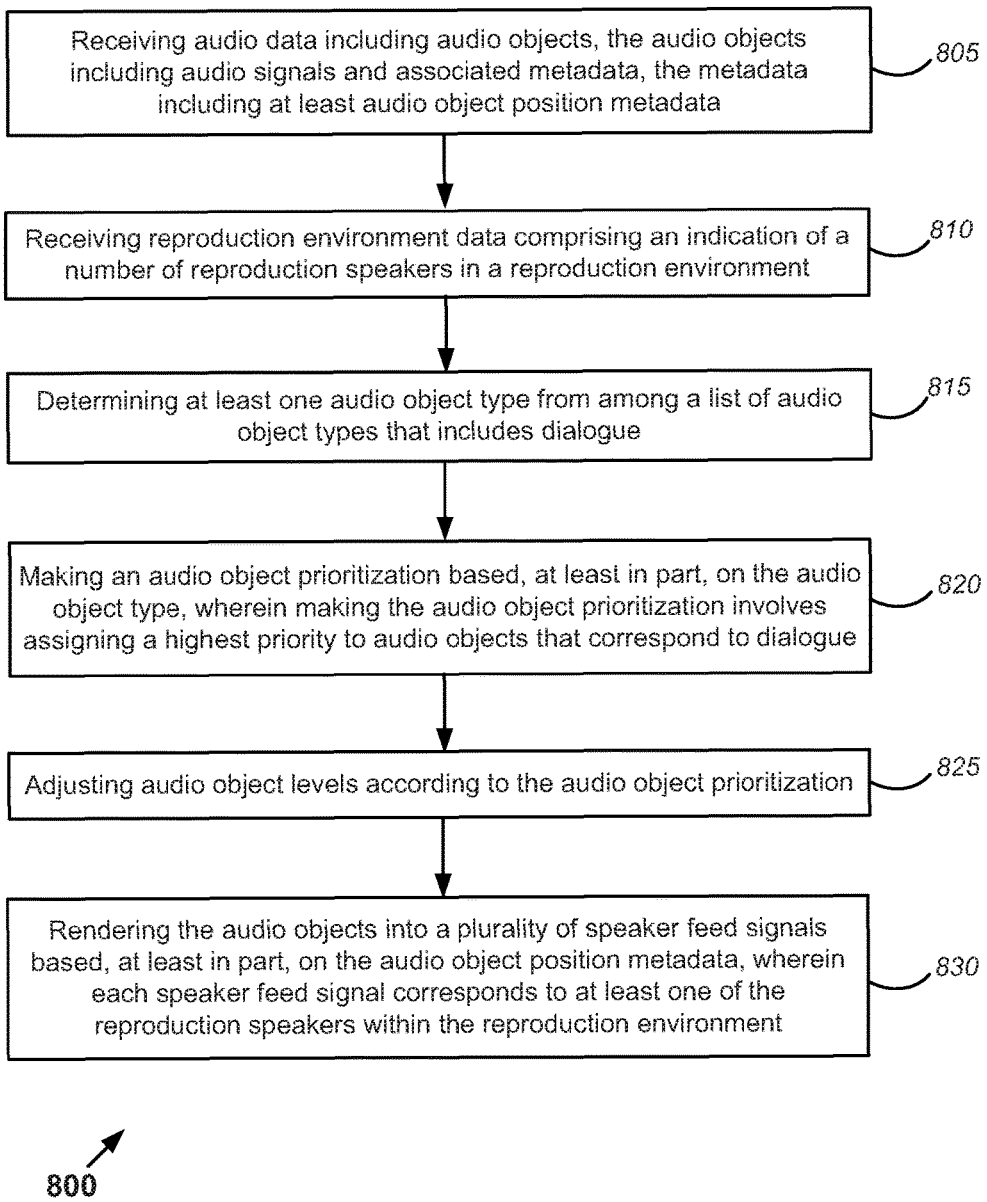
FIG. 8 is a flow diagram that outlines one example of a method that may be performed by the apparatus of FIG. 7.

FIG. 8 is a flow diagram that outlines one example of a method that may be performed by the apparatus of FIG. 7. The blocks of method 800, like other methods described herein, are not necessarily performed in the order indicated. Moreover, such methods may include more or fewer blocks than shown and/or described.

In this implementation, block 805 involves receiving audio data that includes a plurality of audio objects. In this example, the audio objects include audio signals (which may also be referred to herein as "audio object signals") and associated audio object metadata. In this implementation, the audio object metadata includes audio object position metadata. In some implementations, the audio object metadata may include one or more other types of audio object metadata, such as audio object type metadata, audio object size metadata, audio object prioritization metadata and/or one or more other types of audio object metadata.

In the example shown in FIG. 8, block 810 involves receiving reproduction environment data. Here, the reproduction environment data includes an indication of a number of reproduction speakers in a reproduction environment. In some examples, positions of reproduction speakers in the reproduction environment may be determined, or inferred, according to the reproduction environment configuration. Accordingly, the reproduction environment data may or may not include an express indication of positions of reproduction speakers in the reproduction environment. In some implementations, the reproduction environment may be an actual reproduction environment, whereas in other implementations the reproduction environment may be a virtual reproduction environment.

In some examples, the reproduction environment data may include an indication of positions of reproduction speakers in the reproduction environment. In some implementations, the reproduction environment data may include an indication of a reproduction environment configuration. For example, the reproduction environment data may indicate whether the reproduction environment has a Dolby Surround 5.1 configuration, a Dolby Surround 7.1 configuration, a Hamasaki 22.2 surround sound configuration, a headphone configuration, a Dolby Surround 5.1.2 configuration, a Dolby Surround 7.1.2 configuration, a Dolby Atmos configuration or another reproduction environment configuration.

In this implementation, block 815 involves determining at least one audio object type from among a list of audio object types that includes dialogue. For example, a dialogue audio object may correspond to the speech of a particular individual. In some examples, the list of audio object types may include background music, events and/or ambiance. As noted above, in some instances the audio object metadata may include audio object type metadata. According to some such implementations, determining the audio object type may involve evaluating the object type metadata. Alternatively, or additionally, determining the audio object type may involve analyzing the audio signals of audio objects, e.g., as described below.

In the example shown in FIG. 8, block 820 involves making an audio object prioritization based, at least in part, on the audio object type. In this implementation, making the audio object prioritization involves assigning a highest priority to audio objects that correspond to dialogue. In alternative implementations, making the audio object prioritization may involve assigning a highest priority to audio objects according to one or more other attributes, such as audio object volume or level. According to some implementations, some events (such as explosions, bullets sounds, etc.) may be assigned a higher priority than dialogue and other events (such as the sounds of a fire) may be assigned a lower priority than dialogue.

In some examples, the audio object metadata may include audio object size metadata. In some implementations, making an audio object prioritization may involve assigning a relatively lower priority to large or diffuse audio objects. For example, making the audio object prioritization may involve applying a function that reduces a priority of at least some audio objects (e.g., of non-dialogue audio objects) according to increases in audio object size. In some implementations, the function may not reduce the priority of audio objects that are below a threshold size.

In this implementation, block 825 involves adjusting audio object levels according to the audio object prioritization. If the audio object metadata includes audio object prioritization metadata, adjusting the audio object levels may be based, at least in part, on the audio object prioritization metadata. In some implementations, the process of adjusting the audio object levels may be performed on multiple frequency bands of audio signals corresponding to an audio object. Adjusting the audio object levels may involves differentially adjusting levels of various frequency bands. However, in some implementations the process of adjusting the audio object levels may involve determining a single level adjustment for multiple frequency bands.

Some instances may involve selecting at least one audio object that will not be rendered based, at least in part, on the audio object prioritization. According to some such examples, adjusting the audio object's level(s) according to the audio object prioritization may involve adjusting the audio object's level(s) such that the audio object's level(s) fall completely below the normal thresholds of human hearing, or below a particular listener's threshold of hearing. In some such examples, the audio object may be discarded and not rendered.

According to some implementations, adjusting the audio object levels may involve dynamic range compression and/or automatic gain control processes. In some examples, during a process of dynamic range compression, the levels of higher-priority objects may be boosted more, or cut less, than the levels of lower-priority objects.

Some implementations may involve receiving hearing environment data. In some such implementations, the hearing environment data may include a model of hearing loss, data corresponding to a deficiency of at least one reproduction speaker and/or data corresponding to current environmental noise. According to some such implementations, adjusting the audio object levels may be based, at least in part, on the hearing environment data.

In the example shown in FIG. 8, block 830 involves rendering the audio objects into a plurality of speaker feed signals based, at least in part, on the audio object position metadata, wherein each speaker feed signal corresponds to at least one of the reproduction speakers within the reproduction environment. In some examples, the reproduction speakers may be headphone speakers. The reproduction environment may be an actual acoustic space or a virtual acoustic space, depending on the particular implementation.

Accordingly, in some implementations block 830 may involve rendering the audio objects to locations in a virtual acoustic space. In some examples, block 830 may involve rendering the audio objects according to a plurality of virtual speaker locations within a virtual acoustic space. As described in more detail below, some examples may involve increasing a distance between at least some audio objects in the virtual acoustic space. In some instances, the virtual acoustic space may include a front area and a back area. The front area and the back area may, for example, be determined relative to a position of a virtual listener's head in the virtual acoustic space. The rendering may involve increasing a distance between at least some audio objects in the front area of the virtual acoustic space. Increasing this distance may, in some examples, improve the ability of a listener to hear the rendered audio objects more clearly. For example, increasing this distance may make dialogue more intelligible for some listeners.

In some implementations wherein a virtual acoustic space is represented by spherical harmonics (such as the implementations described above with reference to FIG. 5B), the angular separation (as indicated by angle θ and/or φ) between at least some audio objects in the front area of the virtual acoustic space may be increased prior to a rendering process. In some such implementations, the azimuthal angle θ may be "warped" in such a way that at least some angles corresponding to an area in front of the virtual listener's head may be increased and at least some angles corresponding to an area behind the virtual listener's head may be decreased.

Some implementations may involve determining whether an audio object has audio signals that include a directional component and a diffuse component. If it is determined that the audio object has audio signals that include a directional component and a diffuse component, such implementations may involve reducing a level of the diffuse component.

For example, referring to FIGS. 5A and 5B, a single audio object 510 may include a plurality of gains, each of which may correspond with a different position in an actual or virtual space that is within an area or volume of the audio object 510. In FIG. 5B, the gain for each sample 562 is indicated by the size of the corresponding circles 575 within the spread profile 507. The responses of the speakers 580 (which may be real speakers or virtual speakers) are indicated by gray shading in FIG. 5B. In some implementations, gains corresponding to a position at or near the center of the ellipsoid 555 (e.g., the gain represented by the circle 575*a*) may correspond with a directional component of the audio signals, whereas gains corresponding to other positions within the ellipsoid 555 (e.g., the gain represented by the circle 575*b*) may correspond with a diffuse component of the audio signals.

Similarly, referring to FIGS. 5C and 5D, the audio object volumes 520*a* and 520*b* correspond to the size of the corresponding audio object 510. In some implementations, the audio object 510 may be rendered according to the virtual source locations 505 enclosed by the audio object volume 520*a* or 520*b*. In some such implementations, the audio object 510 may have a directional component associated with the position 515, which is in the center of the audio object volumes in these examples, and may have diffuse components associated with other virtual source locations 505 enclosed by the audio object volume 520*a* or 520*b*.

However, in some implementations an audio object's audio signals may include diffuse components that may not directly correspond to audio object size. For example, some such diffuse components may correspond to simulated reverberation, wherein the sound of an audio object source is reflected from various surfaces (such as walls) of a simulated room. By reducing these diffuse components of the audio signals, one can reduce the amount of room reverberation and produce a less "cluttered" sound.

Figure 9A:
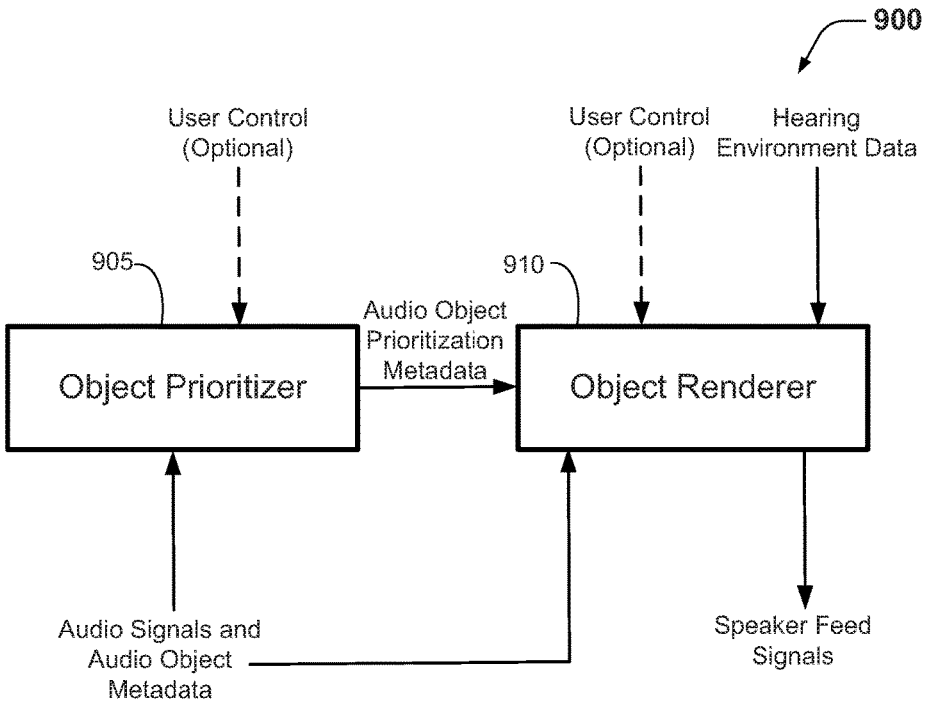
FIG. 9A is a block diagram that shows examples of an object prioritizer and an object renderer.

FIG. 9A is a block diagram that shows examples of an object prioritizer and an object renderer. The apparatus 900 may be implemented via hardware, via software stored on non-transitory media, via firmware and/or by combinations thereof. In some implementations, the apparatus 900 may be implemented in an authoring/content creation context, such as an audio editing context for a video, for a movie, for a game, etc. However, in other implementations the apparatus 900 may be implemented in a cinema context, a home theater context, or another consumer-related context.

In this example, the object prioritizer 905 is capable of making an audio object prioritization based, at least in part, on audio object type. For example, in some implementations, the object prioritizer 905 may assign the highest priority to audio objects that correspond to dialogue. In other implementations, the object prioritizer 905 may assign the highest priority to other types of audio objects, such as audio objects that correspond to events. In some examples, more than one audio object may be assigned the same level of priority. For instance, two audio objects that correspond to dialogue may both be assigned the same priority. In this example, the object prioritizer 905 is capable of providing audio object prioritization metadata to the object renderer 910.

In some examples, the audio object type may be indicated by audio object metadata received by the object prioritizer 905. Alternatively, or additionally, in some implementations the object prioritizer 905 may be capable of making an audio object type determination based, at least in part, on an analysis of audio signals corresponding to audio objects. For example, according to some such implementations the object prioritizer 905 may be capable of making an audio object type determination based, at least in part, on features extracted from the audio signals. In some such implementations, the object prioritizer 905 may include a feature detector and a classifier. One such example is described below with reference to FIG. 10.

According to some examples, the object prioritizer 905 may determine priority based, at least in part, on loudness and/or audio object size. For example, the object prioritizer 905 may indicate a relatively higher priority to relatively louder audio objects. In some instances, the object prioritizer 905 may assign a relatively lower priority to relatively larger audio objects. In some such examples, large audio objects (e.g., audio object having a size that is greater than a threshold size) may be assigned a relatively low priority unless the audio object is loud (e.g., has a loudness that is greater than a threshold level). Additional examples of object prioritization functionality are disclosed herein, including but not limited to those provided by FIG. 10 and the corresponding description.

In the example shown in FIG. 9A, the object prioritizer 905 may be capable of receiving user input. Such user input may, for example, be received via a user input system of the apparatus 900. The user input system may include a touch sensor or gesture sensor system and one or more associated controllers, a microphone for receiving voice commands and one or more associated controllers, a display and one or more associated controllers for providing a graphical user interface, etc. The controllers may be part of a control system such as the control system 710 that is shown in FIG. 7 and described above. However, in some examples one or more of the controllers may reside in another device. For example, one or more of the controllers may reside in a server that is capable of providing voice activity detection functionality.

In some such implementations, a prioritization method applied by the object prioritizer 905 may be based, at least in part, on such user input. For example, in some implementations the type of audio object that will be assigned the highest priority may be determined according to user input. According to some examples, the priority level of selected audio objects may be determined according to user input. Such capabilities may, for example, be useful in the content creation/authoring context, e.g., for post-production editing of the audio for a movie, a video, etc. In some implementations, the number of priority levels in a hierarchy of priorities may be changed according to user input. For example, some such implementations may have a "default" number of priority levels (such as three levels corresponding to a highest level, a middle level and a lowest level). In some implementations, the number of priority levels may be increased or decreased according to user input (e.g., from 3 levels to 5 levels, from 4 levels to 3 levels, etc.).

In the implementation shown in FIG. 9A, the object renderer 910 is capable of generating speaker feed signals for a reproduction environment based on received hearing environment data, audio signals and audio object metadata. The reproduction environment may be a virtual reproduction environment or an actual reproduction environment, depending on the particular implementation. In this example, the audio object metadata includes audio object prioritization metadata that is received from the object prioritizer 905. As noted elsewhere herein, the renderer may generate the speaker feed signals according to a particular reproduction environment configuration, which may be a headphone configuration, a non-headphone stereo configuration, a Dolby Surround 5.1 configuration, a Dolby Surround 7.1 configuration, a Hamasaki 22.2 surround sound configuration, a Dolby Surround 5.1.2 configuration, a Dolby Surround 7.1.2 configuration, a Dolby Atmos configuration, or some other configuration.

In some implementations the object renderer 910 may be capable of rendering audio objects to locations in a virtual acoustic space. In some such examples the object renderer 910 may be capable of increasing a distance between at least some audio objects in the virtual acoustic space. In some instances, the virtual acoustic space may include a front area and a back area. The front area and the back area may, for example, be determined relative to a position of a virtual listener's head in the virtual acoustic space. In some implementations, the object renderer 910 may be capable of increasing a distance between at least some audio objects in the front area of the virtual acoustic space.

The hearing environment data may include a model of hearing loss. According to some implementations, such a model may be an audiogram of a particular individual, based on a hearing examination. Alternatively, or additionally, the hearing loss model may be a statistical model based on empirical hearing loss data for many individuals. In some examples, hearing environment data may include a function that may be used to calculate loudness (e.g., per frequency band) based on excitation level.

In some instances, the hearing environment data may include data regarding a characteristic (e.g., a deficiency) of at least one reproduction speaker. Some speakers may, for example, distort when driven at particular frequencies. According to some such examples, the object renderer 910 may be capable of generating speaker feed signals in which the gain is adjusted (e.g., on a per-band basis), based on the characteristics of a particular speaker system.

According to some implementations, the hearing environment data may include data regarding current environmental noise. For example, the apparatus 900 may receive a raw audio feed from a microphone or processed audio data that is based on audio signals from a microphone. In some implementations the apparatus 900 may include a microphone capable of providing data regarding current environmental noise. According to some such implementations, the object renderer 910 may be capable of generating speaker feed signals in which the gain is adjusted (e.g., on a per-band basis), based at least in part, on the current environmental noise. Additional examples of object renderer functionality are disclosed herein, including but not limited to the examples provided by FIG. 11 and the corresponding description.

The object renderer 910 may operate, at least in part, according to user input. In some examples, the object renderer 910 may be capable of modifying a distance (e.g., an angular separation) between at least some audio objects in the front area of a virtual acoustic space according to user input.

Figure 9B:
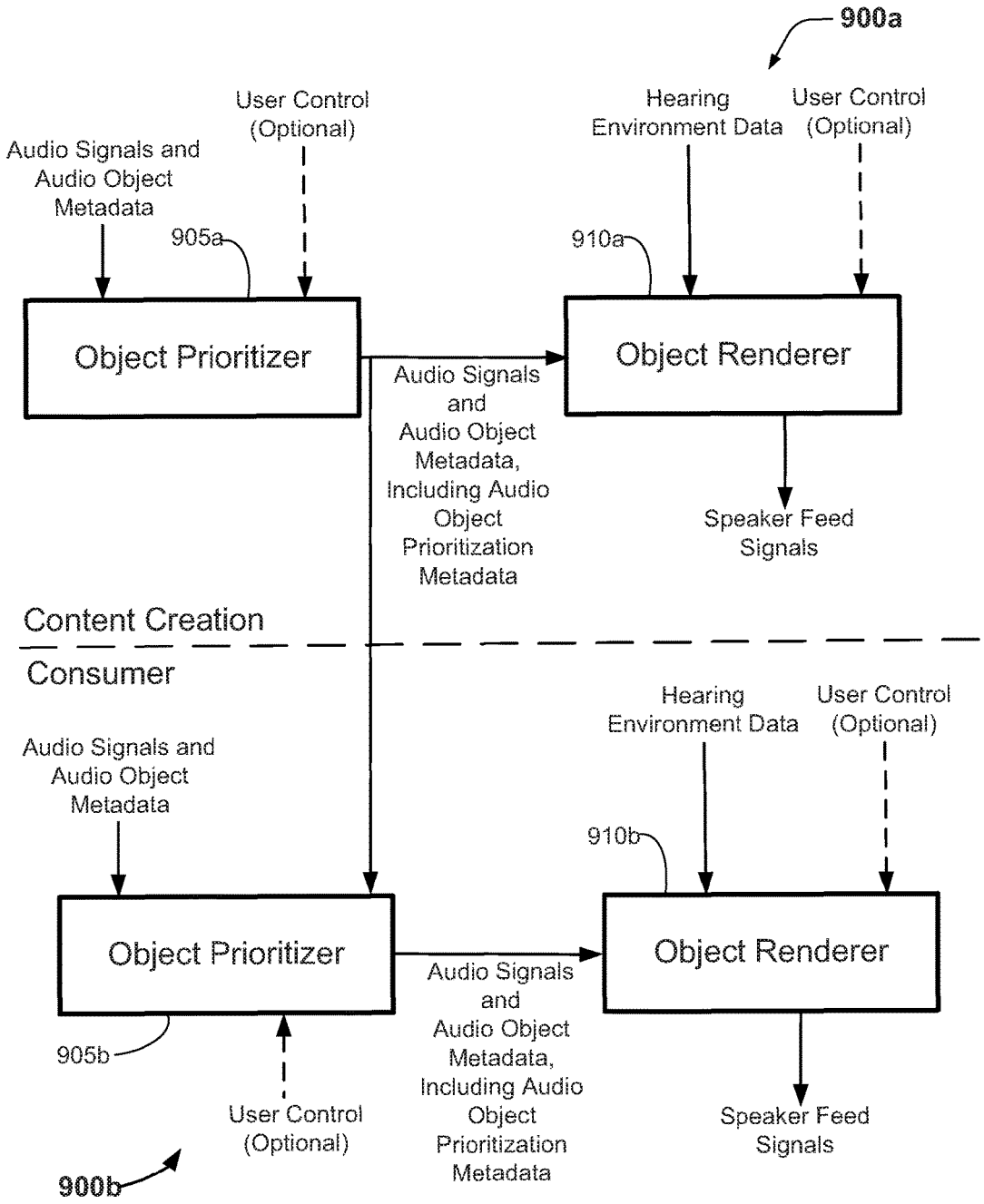
FIG. 9B shows an example of object prioritizers and object renderers in two different contexts.

FIG. 9B shows an example of object prioritizers and object renderers in two different contexts. The apparatus 900*a*, which includes an object prioritizer 905*a* and an object renderer 910*a*, is capable of operating in a content creation context in this example. The content creation context may, for example, be an audio editing environment, such as a post-production editing environment, a sound effects creation environment, etc. Audio objects may be prioritized, e.g., by the object prioritizer 905*a*. According to some implementations, the object prioritizer 905*a* may be capable of determining suggested or default priority levels that a content creator could optionally adjust, according to user input. Corresponding audio object prioritization metadata may be created by the object prioritizer 905*a* and associated with audio objects.

The object renderer 910*a* may be capable of adjusting the levels of audio signals corresponding to audio objects according to the audio object prioritization metadata and of rendering the audio objects into a plurality of speaker feed signals based, at least in part, on the audio object position metadata. According to some such implementations, part of the content creation process may involve auditioning or testing the suggested or default priority levels determined by the object prioritizer 905*a* and adjusting the object prioritization metadata accordingly. Some such implementations may involve an iterative process of auditioning/testing and adjusting the priority levels according to a content creator's subjective impression of the audio playback, to ensure preservation of the content creator's creative intent. The object renderer 910*a* may be capable of adjusting audio object levels according to received hearing environment data. In some examples, the object renderer 910*a* may be capable of adjusting audio object levels according to a hearing loss model included in the hearing environment data.

The apparatus 900*b*, which includes an object prioritizer 905*b* and an object renderer 910*b*, is capable of operating in a consumer context in this example. The consumer context may, for example, be a cinema environment, a home theater environment, a mobile display device, etc. In this example, the apparatus 900*b* receives prioritization metadata along with audio objects, corresponding audio signals and other metadata, such as position metadata, size metadata, etc. In this implementation, the object renderer 910*b* produces speaker feed signals based on the audio object signals, audio object metadata and hearing environment data. In this example, the apparatus 900*b* includes an object prioritizer 905*b*, which may be convenient for instance in which the prioritization metadata is not available. In this implementation, the object prioritizer 905*b* is capable of making an audio object prioritization based, at least in part, on audio object type and of providing audio object prioritization metadata to the object renderer 910*b*. However, in alternative implementations the apparatus 900*b* may not include the object prioritizer 905*b*.

In the examples shown in FIG. 9B, both the object prioritizer 905*b* and the object renderer 910*b* may optionally function according to received user input. For example, a consumer (such as a home theater owner or a cinema operator) may audition or "preview" rendered speaker feed signals according to one set of audio object prioritization metadata (e.g., a set of audio object prioritization metadata that is output from a content creation process) to determine whether the corresponding played-back audio is satisfactory for a particular reproduction environment. If not, in some implementations a user may invoke the operation of a local object prioritizer, such as the object prioritizer 905*b*, and may optionally provide user input. This operation may produce a second set of audio object prioritization metadata that may be rendered into speaker feed signals by the object renderer 910*b* and auditioned. The process may continue until the consumer believes the resulting played-back audio is satisfactory.

Figure 9C:
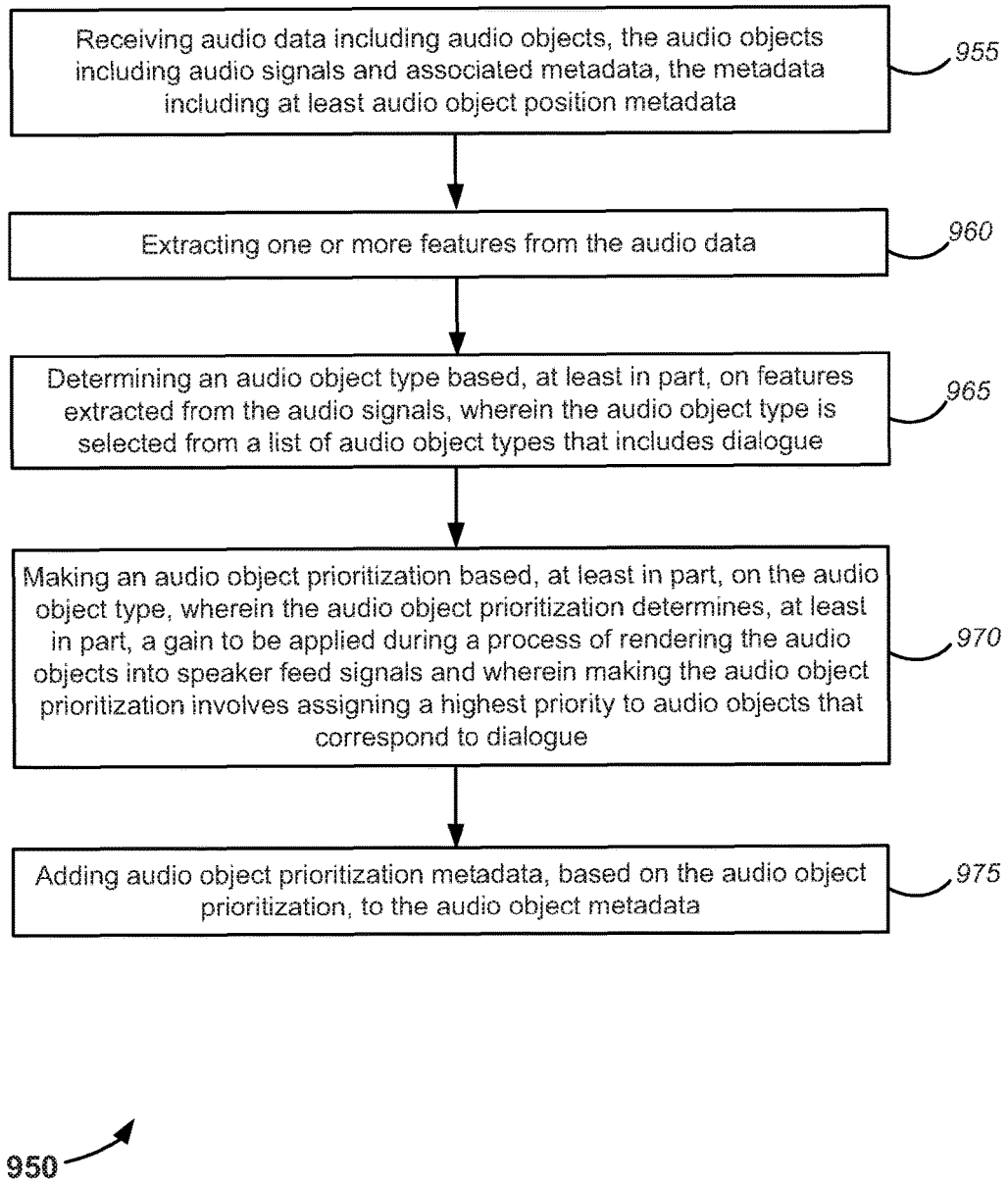
FIG. 9C is a flow diagram that outlines one example of a method that may be performed by apparatus such as those shown in FIGS. 7, 9A and/or 9B.

FIG. 9C is a flow diagram that outlines one example of a method that may be performed by apparatus such as those shown in FIGS. 7, 9A and/or 9B. For example, in some implementations method 950 may be performed by the apparatus 900*a*, in a content creation context. In some such examples, method 950 may be performed by the object prioritizer 905*a*. However, in some implementations method 950 may be performed by the apparatus 900*b*, in a consumer context. The blocks of method 950, like other methods described herein, are not necessarily performed in the order indicated. Moreover, such methods may include more or fewer blocks than shown and/or described.

In this implementation, block 955 involves receiving audio data that includes a plurality of audio objects. In this example, the audio objects include audio signals and associated audio object metadata. In this implementation, the audio object metadata includes audio object position metadata. In some implementations, the audio object metadata may include one or more other types of audio object metadata, such as audio object type metadata, audio object size metadata, audio object prioritization metadata and/or one or more other types of audio object metadata.

In the example shown in FIG. 9C, block 960 involves extracting one or more features from the audio data. The features may, for example, include spectral flux, loudness, audio object size, entropy-related features, harmonicity features, spectral envelope features, phase features and/or temporal features. Some examples are described below with reference to FIG. 10.

In this implementation, block 965 involves determining an audio object type based, at least in part, on the one or more features extracted from the audio signals. In this example, the audio object type is selected from among a list of audio object types that includes dialogue. For example, a dialogue audio object may correspond to the speech of a particular individual. In some examples, the list of audio object types may include background music, events and/or ambiance. As noted above, in alternative implementations the audio object metadata may include audio object type metadata. According to some such implementations, determining the audio object type may involve evaluating the object type metadata.

In the example shown in FIG. 9C, block 970 involves making an audio object prioritization based, at least in part, on the audio object type. In this example, the audio object prioritization determines, at least in part, a gain to be applied during a subsequent process of rendering the audio objects into speaker feed signals. In this implementation, making the audio object prioritization involves assigning a highest priority to audio objects that correspond to dialogue. In alternative implementations, making the audio object prioritization may involve assigning a highest priority to audio objects according to one or more other attributes, such as audio object volume or level. According to some implementations, some events (such as explosions, bullets sounds, etc.) may be assigned a higher priority than dialogue and other events (such as the sounds of a fire) may be assigned a lower priority than dialogue.

In this example, block 975 involves adding audio object prioritization metadata, based on the audio object prioritization, to the audio object metadata. The audio objects, including the corresponding audio signals and audio object metadata, may be provided to an audio object renderer.

As described in more detail below with reference to FIG. 10, some implementations involve determining a confidence score regarding each audio object type determination and applying a weight to each confidence score to produce a weighted confidence score. The weight may correspond to the audio object type determination. In such implementations, making the audio object prioritization may be based, at least in part, on the weighted confidence score. In some examples, determining the audio object type may involve a machine learning method.

Some implementations of method 950 may involve receiving hearing environment data comprising a model of hearing loss and adjusting audio object levels according to the audio object prioritization and the hearing environment data. Such implementations also may involve rendering the audio objects into a plurality of speaker feed signals based, at least in part, on the audio object position metadata. Each speaker feed signal may correspond to at least one of the reproduction speakers within the reproduction environment.

The rendering process also may be based on reproduction environment data, which may include an express or implied indication of a number of reproduction speakers in a reproduction environment. In some examples, positions of reproduction speakers in the reproduction environment may be determined, or inferred, according to the reproduction environment configuration. Accordingly, the reproduction environment data may not need to include an express indication of positions of reproduction speakers in the reproduction environment. In some implementations, the reproduction environment data may include an indication of a reproduction environment configuration.

In some examples, the reproduction environment data may include an indication of positions of reproduction speakers in the reproduction environment. In some implementations, the reproduction environment may be an actual reproduction environment, whereas in other implementations the reproduction environment may be a virtual reproduction environment. Accordingly, in some implementations the audio object position metadata may indicate locations in a virtual acoustic space.

As discussed elsewhere herein, in some instances the audio object metadata may include audio object size metadata. Some such implementations may involve receiving indications of a plurality of virtual speaker locations within the virtual acoustic space and rendering the audio objects to the plurality of virtual speaker locations within the virtual acoustic space based, at least in part, on the audio object position metadata and the audio object size metadata.

Figure 10:
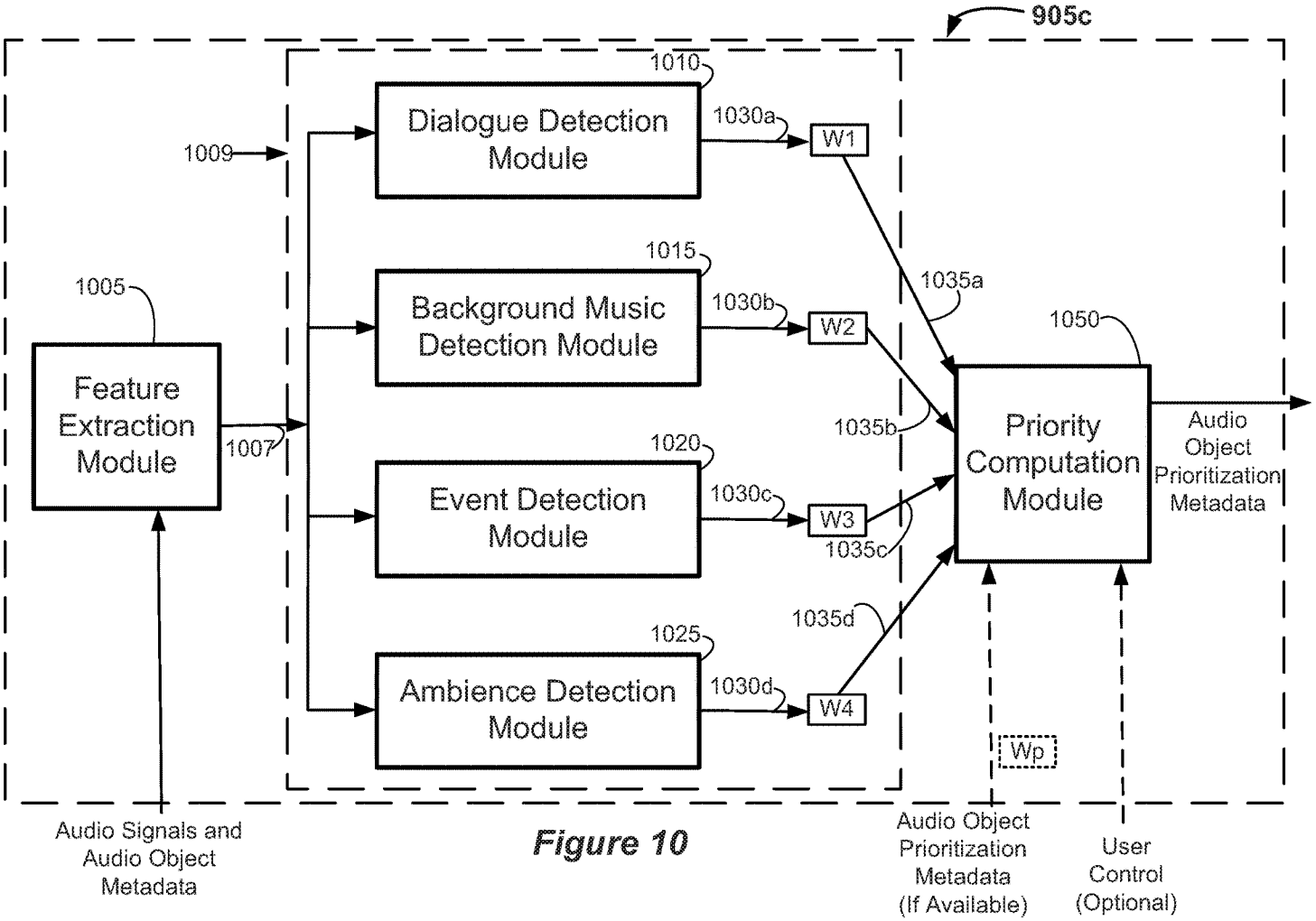
FIG. 10 is a block diagram that shows examples of object prioritizer elements according to one implementation.

FIG. 10 is a block diagram that shows examples of object prioritizer elements according to one implementation. The types and numbers of components shown in FIG. 10 are merely shown by way of example. Alternative implementations may include more, fewer and/or different components. The object prioritizer 905*c* may, for example, be implemented via hardware, via software stored on non-transitory media, via firmware and/or by combinations thereof. In some examples, object prioritizer 905*c* may be implemented via a general purpose single- or multi-chip processor, a digital signal processor (DSP), an application specific integrated circuit (ASIC), a field programmable gate array (FPGA) or other programmable logic device, discrete gate or transistor logic, and/or discrete hardware components. In some implementations, the object prioritizer 905*c* may be implemented in an authoring/content creation context, such as an audio editing context for a video, for a movie, for a game, etc. However, in other implementations the object prioritizer 905*c* may be implemented in a cinema context, a home theater context, or another consumer-related context.

In this example, the object prioritizer 905*c* includes a feature extraction module 1005, which is shown receiving audio objects, including corresponding audio signals and audio object metadata. In this implementation, the feature extraction module 1005 is capable of extracting features from received audio objects, based on the audio signals and/or the audio object metadata. According to some such implementations, the set of features may be correspond with temporal, spectral and/or spatial properties of the audio objects. The features extracted by the feature extraction module 1005 may include spectral flux, e.g., at the syllable rate, which may be useful for dialog detection. In some examples, the features extracted by the feature extraction module 1005 may include one or more entropy features, which may be useful for dialog and ambiance detection.

According to some implementations, the features may include temporal features, one or more indicia of loudness and/or one or more indicia of audio object size, all of which may be useful for event detection. In some such implementations, the audio object metadata may include an indication of audio object size. In some examples, the feature extraction module 1005 may extract harmonicity features, which may be useful for dialog and background music detection. Alternatively, or additionally, the feature extraction module 1005 may extract spectral envelope features and/or phase features, which may be useful for modeling the spectral properties of the audio signals.

In the example shown in FIG. 10, the feature extraction module 1005 is capable of providing the extracted features 1007, which may include any combination of the above-mentioned features (and/or other features), to the classifier 1009. In this implementation, the classifier 1009 includes a dialogue detection module 1010 that is capable of detecting audio objects that correspond with dialogue, a background music detection module 1015 that is capable of detecting audio objects that correspond with background music, an event detection module 1020 that is capable of detecting audio objects that correspond with events (such as a bullet being fired, a door opening, an explosion, etc.) and an ambience detection module 1025 that is capable of detecting audio objects that correspond with ambient sounds (such as rain, traffic sounds, wind, surf, etc.). In other examples, the classifier 1009 may include more or fewer elements.

According to some examples, the classifier 1009 may be capable of implementing a machine learning method. For example, the classifier 1009 may be capable of implementing a Gaussian Mixture Model (GMM), a Support Vector Machine (SVM) or an Adaboost machine learning method. In some examples, the machine learning method may involve a "training" or set-up process. This process may have involved evaluating statistical properties of audio objects that are known to be particular audio object types, such as dialogue, background music, events, ambient sounds, etc. The modules of the classifier 1009 may have been trained to compare the characteristics of features extracted by the feature extraction module 1005 with "known" characteristics of such audio object types. The known characteristics may be characteristics of dialogue, background music, events, ambient sounds, etc., which have been identified by human beings and used as input for the training process. Such known characteristics also may be referred to herein as "models."

In this implementation, the each element of the classifier 1009 is capable of generating and outputting a confidence score, which are shown as confidence scores 1030*a*-1030*d* in FIG. 10. In this example, each of the confidence scores 1030*a*-1030*d* represents how close one or more characteristics of features extracted by the feature extraction module 1005 are to characteristics of a particular model. For example, if an audio object corresponds to people talking, then the dialog detection module 1010 may produce a high confidence score, whereas the background music detection module 1015 may produce a low confidence score.

In this example, the classifier 1009 is capable of applying a weighting factor W to each of the confidence scores 1030*a*-1030*d*. According to some implementations, each of the weighting factors W1-W4 may be the results of a previous training process on manually labeled data, using a machine learning method such as one of those described above. In some implementations, the weighting factors W1-W4 may have positive or negative constant values. In some examples, the weighting factors W1-W4 may be updated from time to time according to relatively more recent machine learning results. The weighting factors W1-W4 should result in priorities that provide improved experience for hearing impaired listeners. For example, in some implementations dialog may be assigned a higher priority, because dialogue is typically the most important part of an audio mix for a video, a movie, etc. Therefore, the weighting factor W1 will generally be positive and larger than the weighting factors W2-W4. The resulting weighted confidence scores 1035*a*-1035*d* may be provided to the priority computation module 1050. If audio object prioritization metadata is available (for example, if audio object prioritization metadata is received with the audio signals and other audio object metadata, a weighting value Wp may be applied according to the audio object prioritization metadata.

In this example, the priority computation module 1050 is capable of calculating a sum of the weighted confidence scores in order to produce the final priority, which is indicated by the audio object prioritization metadata output by the priority computation module 1050. In alternative implementations, the priority computation module 1050 may be capable of producing the final priority by applying one or more other types of functions to the weighted confidence scores. For example, in some instances the priority computation module 1050 may be capable of producing the final priority by applying a nonlinear compressing function to the weighted confidence scores, in order to make the output within a predetermined range, for example between 0 and 1. If audio object prioritization metadata is present for a particular audio object, the priority computation module 1050 may bias the final priority according to the priority indicated by the received audio object prioritization metadata. In this implementation, the priority computation module 1050 is capable of changing the priority assigned to audio objects according to optional user input. For example, a user may be able to modify the weighting values in order to increase the priority of background music and/or another audio object type relative to dialogue, to increase the priority of a particular audio object as compared to the priority of other audio objects of the same audio object type, etc.

Figure 11:
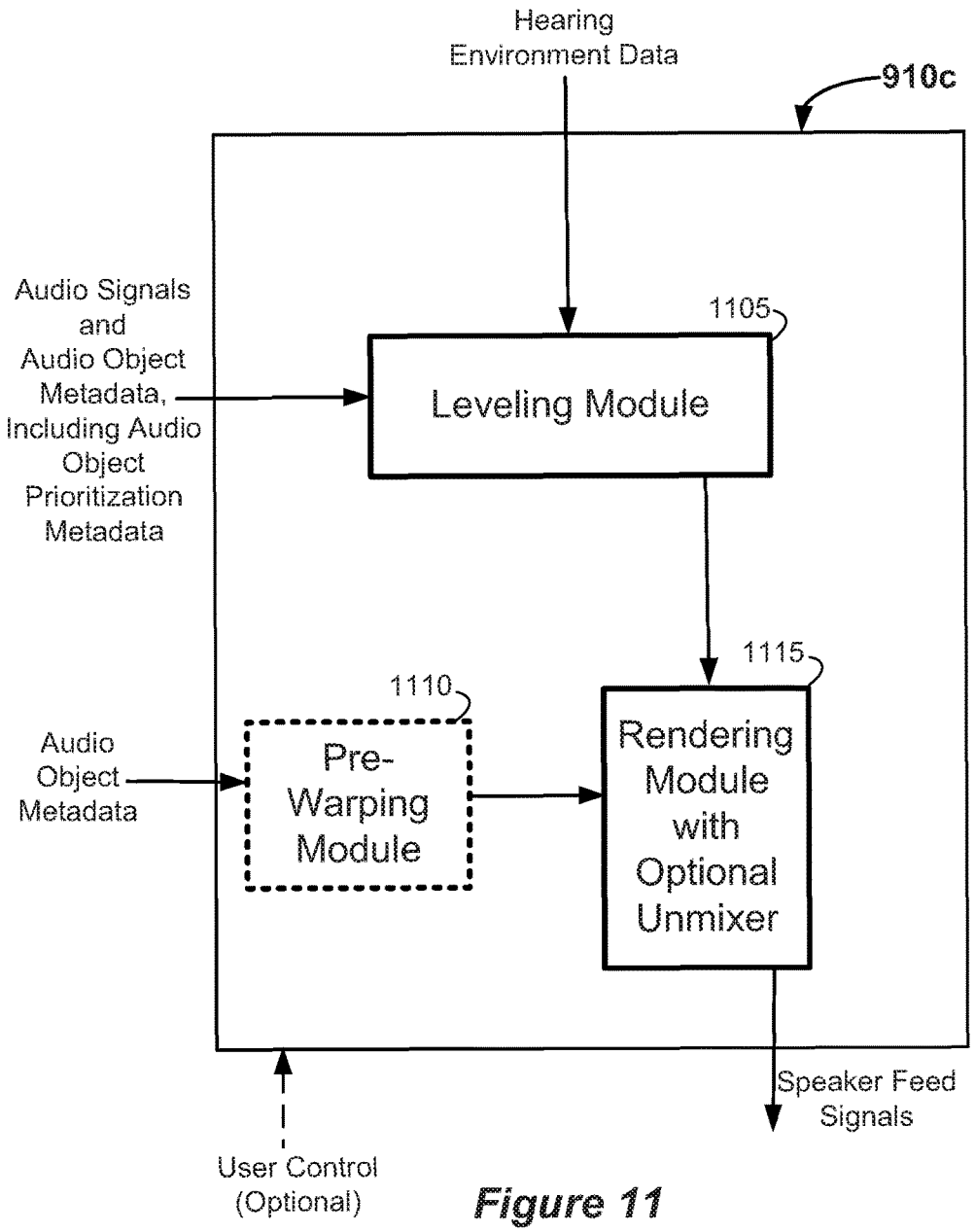
FIG. 11 is a block diagram that shows examples of object renderer elements according to one implementation.
Figure 12:
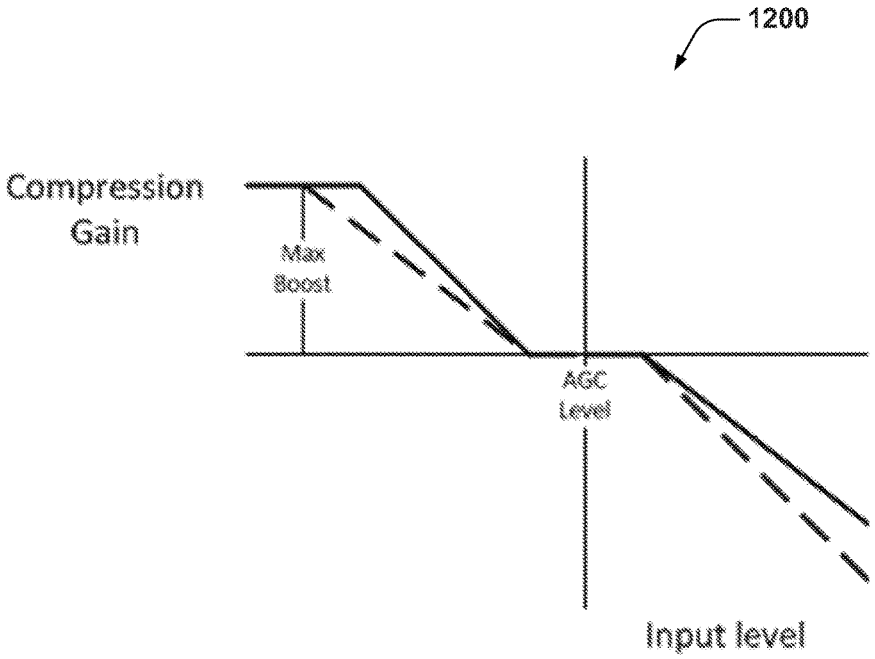
FIG. 12 shows examples of dynamic range compression curves.

FIG. 11 is a block diagram that shows examples of object renderer elements according to one implementation. The types and numbers of components shown in FIG. 11 are merely shown by way of example. Alternative implementations may include more, fewer and/or different components. The object renderer 910*c* may, for example, be implemented via hardware, via software stored on non-transitory media, via firmware and/or by combinations thereof. In some examples, object renderer 910*c* may be implemented via a general purpose single- or multi-chip processor, a digital signal processor (DSP), an application specific integrated circuit (ASIC), a field programmable gate array (FPGA) or other programmable logic device, discrete gate or transistor logic, and/or discrete hardware components. In some implementations, the object renderer 910*c* may be implemented in an authoring/content creation context, such as an audio editing context for a video, for a movie, for a game, etc. However, in other implementations the object renderer 910*c* may be implemented in a cinema context, a home theater context, or another consumer-related context.

In this example, the object renderer 910*c* includes a leveling module 1105, a pre-warping module 1110 and a rendering module 1115. In some implementations, as here, the rendering module 1115 includes an optional unmixer.

In this example, the leveling module 1105 is capable of receiving hearing environment data and of leveling audio signals based, at least in part, on the hearing environment data. In some implementations, the hearing environment data may include a hearing loss model, information regarding a reproduction environment (e.g., information regarding noise in the reproduction environment) and/or information regarding rendering hardware in the reproduction environment, such as information regarding the capabilities of one or more speakers of the reproduction environment. As noted above, the reproduction environment may include a headphone configuration, a virtual speaker configuration or an actual speaker configuration.

The leveling module 1105 may function in a variety of ways. The functionality of the leveling module 1105 may, for example, depend on the available processing power of the object renderer 910*c*. According to some implementations, the leveling module 1105 may operate according to a multiband compressor method. In some such implementations, adjusting the audio object levels may involve dynamic range compression. For example, referring to FIG. 12, two DRC curves are shown. The solid line shows a sample DRC compression gain curve tuned for hearing loss. For example, audio objects with the highest priority may be leveled according to this curve. For a lower-priority audio object, the compression gain slopes may be adjusted as shown by the dashed line, receiving less boost and more cut than higher-priority audio objects. According to some implementations, the audio object priority may determine the degree of these adjustments. The units of the curves correspond to level or loudness. The DRC curves may be tuned per band according to, e.g., a hearing loss model, environmental noise, etc. Examples of more complex functionality of the leveling module 1105 are described below with reference to FIG. 13. The output from the leveling module 1105 is provided to the rendering module 1115 in this example.

As described elsewhere herein, some implementations may involve increasing a distance between at least some audio objects in a virtual acoustic space. In some instances, the virtual acoustic space may include a front area and a back area. The front area and the back area may, for example, be determined relative to a position of a virtual listener's head in the virtual acoustic space.

According to some implementations, the pre-warping module 1110 may be capable of receiving audio object metadata, including audio object position metadata, and increasing a distance between at least some audio objects in the front area of the virtual acoustic space. Increasing this distance may, in some examples, improve the ability of a listener to hear the rendered audio objects more clearly. In some examples, the pre-warping module may adjust a distance between at least some audio objects according to user input. The output from the pre-warping module 1110 is provided to the rendering module 1115 in this example.

In this example, the rendering module 1115 is capable of rendering the output from the leveling module 1105 (and, optionally, output from the pre-warping module 1110) into speaker feed signals. As noted elsewhere, the speaker feed signals may correspond to virtual speakers or actual speakers.

In this example, the rendering module 1115 includes an optional "unmixer." According to some implementations, the unmixer may apply special processing to at least some audio objects according to audio object size metadata. For example, the unmixer may be capable of determining whether an audio object has corresponding audio signals that include a directional component and a diffuse component. The unmixer may be capable of reducing a level of the diffuse component. According to some implementations, the unmixer may only apply such processing to audio objects that are at or above a threshold audio object size.

Figure 13:
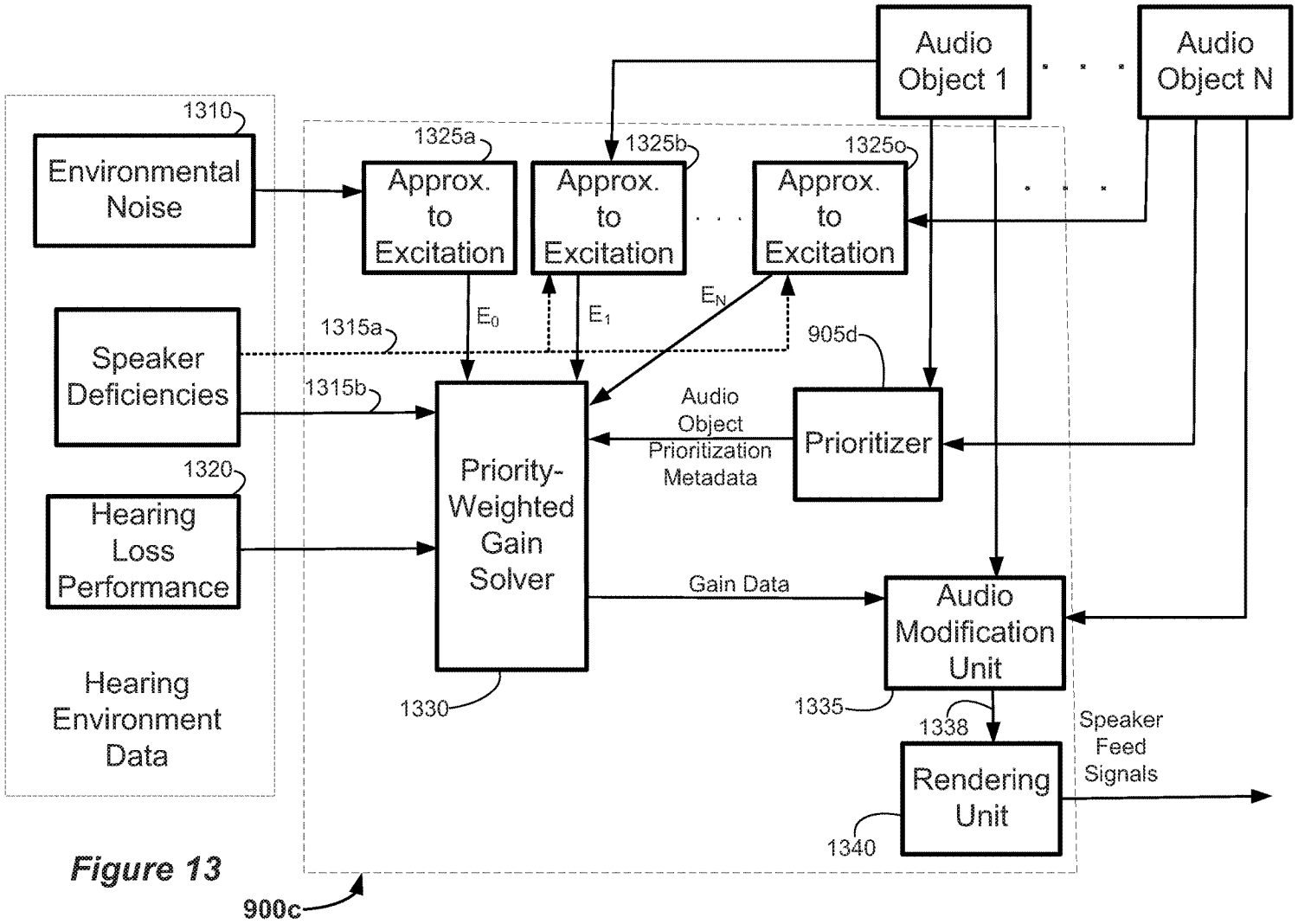
FIG. 13 is a block diagram that illustrates examples of elements in a more detailed implementation.

FIG. 13 is a block diagram that illustrates examples of elements in a more detailed implementation. The types and numbers of components shown in FIG. 13 are merely shown by way of example. Alternative implementations may include more, fewer and/or different components. The apparatus 900*c* may, for example, be implemented via hardware, via software stored on non-transitory media, via firmware and/or by combinations thereof. In some examples, apparatus 900*c* may be implemented via a general purpose single- or multi-chip processor, a digital signal processor (DSP), an application specific integrated circuit (ASIC), a field programmable gate array (FPGA) or other programmable logic device, discrete gate or transistor logic, and/or discrete hardware components. In some implementations, the apparatus 900*c* may be implemented in an authoring/content creation context, such as an audio editing context for a video, for a movie, for a game, etc. However, in other implementations the apparatus 900*c* may be implemented in a cinema context, a home theater context, or another consumer-related context.

In this example, the apparatus 900*c* includes a prioritizer 905*d*, excitation approximation modules 1325*a*-1325*o*, a gain solver 1330, an audio modification unit 1335 and a rendering unit 1340. In this particular implementation, the prioritizer 905*d* is capable of receiving audio objects 1 through N, prioritizing the audio objects 1 through N and providing corresponding audio object prioritization metadata to the gain solver 1330. In this example, the gain solver 1330 is a priority-weighted gain solver, which may function as described in the detailed discussion below.

In this implementation, the excitation approximation modules 1325*b*-1325*o* are capable of receiving the audio objects 1 through N, determining corresponding excitations $E_1$-$E_N$ and providing the excitations $E_1$-$E_N$ to the gain solver 1330. In this example, the excitation approximation modules 1325*b*-1325*o* are capable of determining corresponding excitations $E_1$-$E_N$ based, in part, on the speaker deficiency data 1315*a*. The speaker deficiency data 1315*a* may, for example, correspond with linear frequency response deficiencies of one or more speakers. According to this example, the excitation approximation module 1325*a* is capable of receiving environmental noise data 1310, determining a corresponding excitation $E_0$ and providing the excitation $E_0$ to the gain solver 1330.

In this example, other types of hearing environment data, including speaker deficiency data 1315*b* and hearing loss performance data 1320, are provided to the gain solver 1330. In this implementation, the speaker deficiency data 1315*b* correspond to speaker distortion. According to this implementation, the gain solver 1330 is capable of determining gain data based on the excitations $E_0$-$E_N$ and the hearing environment data, and of providing the gain data to the audio modification unit 1335.

In this example, the audio modification unit 1335 is capable of receiving the audio objects 1 through N and modifying gains based, at least in part, on the gain data received from the gain solver 1330. Here, the audio modification unit 1335 is capable of providing gain-modified audio objects 1338 to the rendering unit 1340. In this implementation, the rendering unit 1340 is capable of generating speaker feed signals based on the gain-modified audio objects 1338.

The operation of the elements of FIG. 13, according to some implementations, may be further understood with reference to the following remarks. Let $LR_i$ be the loudness with which a person without hearing loss, in a noise-free playback environment, would perceive audio object i, after automatic gain control has been applied. This loudness, which may be calculated with a reference hearing model, depends on the level of all the other audio objects present. (In order to understand this phenomenon, consider that when another audio object is much louder than an audio object one may not be able to hear the audio object at all, so the audio object's perceived loudness is zero).

In general, loudness also depends on the environmental noise, hearing loss and speaker deficiencies. Under these conditions the same audio object will be perceived with a loudness $LHL_i$. This may be calculated using a hearing model H that includes hearing loss.

The goal of some implementations is to apply gains in spectral bands of each audio object such that, after these gains have been applied, $LHL_i$=$LR_i$ for all the audio objects. In this case, every audio object may be perceived as a content creator intended for them to be perceived. If a person with reference hearing listened to the result, that person would perceive the result as if the audio objects had undergone dynamic range compression, as the signals inaudible to the person with hearing loss would have increased in loudness and the signals that the person with hearing loss perceived as too loud would be reduced in loudness. This defines for us an objective goal of dynamic range compression matched to the environment.

However, because the perceived loudness of every audio object depends on that of every other audio object, this cannot in general be satisfied for all audio objects. The solution of some disclosed implementations is to acknowledge that some audio objects may be more important than others, from a listener's point of view, and to assign audio object priorities accordingly. The priority weighted gain solver may be capable of calculating gains such that the difference or "distance" between $LHL_i$ and $LR_i$ is small for the highest-priority audio objects and larger for lower-priority audio objects. This inherently results in reducing the gains on lower-priority audio objects, in order to reduce their influence. In one example, the gain solver calculates gains that minimize the following expression:

$$\min \sum_i p_i(LHL_i(b) - LR_i(b))^2 \qquad \text{(Equation 2)}$$

In Equation 2, $p_i$ represents the priority assigned to audio object i, and $LHL_i$ and $LR_i$ are represented in the log domain. Other implementations may use other "distance" metrics, such as the absolute value of the loudness difference instead of the square of the loudness difference.

In one example of a hearing loss model, the loudness is calculated from the sum of the specific loudness in each spectral band N(b), which in turn is a function of the distribution of energy along the basilar membrane of the human ear, which we refer to herein as excitation E. Let $E_i$(b,ear) denote the excitation at the left or right ear due to audio object i in spectral band b.

$$LHL_i = \log\left[\sum_{b,ears} N_{HL}\left\{E_i(b, \text{ear}), \sum_{j \neq i}[g_j(b)E_j(b, \text{ear})] + E_0(b, \text{ear}), b\right\}\right] \qquad \text{(Equation 3)}$$

In Equation 3, $E_0$ represents the excitation due to the environmental noise, and thus we will generally not be able to control gains for this excitation. $N_{HL}$ represents the specific loudness, given the current hearing loss parameters, and $g_i$ are the gains calculated by the priority-weighted gain solver for each audio object i. Similarly, $$LR_i = \log\left[\sum_{b,ears} N_R\left\{E_i(b, \text{ear}), \sum_{j \neq i}[E_j(b, \text{ear})] + E_0(b, \text{ear}), b\right\}\right] \qquad \text{(Equation 4)}$$

In Equation 4, $N_R$ is the specific loudness under the reference conditions of no hearing loss and no environmental noise. The loudness values and gains may undergo smoothing across time before being applied. Gains also may be smoothed across bands, to limit distortions caused by a filter bank.

In some implementations, the system may be simplified. For example, some implementations are capable of solving for a single broadband gain for the audio object i by letting $g_i(b)$=$g_i$ Such implementations can, in some instances, dramatically reduce the complexity of the gain solver. Moreover, such implementations may improve the problem that users are used to listening through their hearing loss, and thus may sometimes be annoyed by the extra brightness if the highs are restored to the reference loudness levels.

Other simplified implementations may involve a hybrid system that has per-band gains for one type of audio object (e.g., for dialogue) and broadband gains for other types of audio object. Such implementations can making the dialog more intelligible, but can leave the timbre of the overall audio largely unchanged.

Still other simplified implementations may involve making some assumptions regarding the spectral energy distribution, e.g., by measuring in fewer bands and interpolating. One very simple approach involves making an assumption that all audio objects are pink noise signals and simply measuring the audio objects' energy. Then, $E_i(b)=k_b\ E_i$, where the constants $k_b$ represent the pink noise characteristic.

The passage of the audio through the speaker's response, and through the head-related transfer function, then through the outer ear and the middle ear can all be modeled with a relatively simple transfer function. An example of a middle ear transfer function is shown in FIG. 1 of Brian C. J. Moore and Brian R. Glasberg, *A Revised Model of Loudness Perception Applied to Cochlear Hearing Loss*, in Hearing Research, 188 (2004) ("MG2004") and the corresponding discussion, which are hereby incorporated by reference. An example transfer function through the outer ear for a frontal source is given in FIG. 1 of Brian R. Glasberg, Brian C. J. Moore and Thomas Baer, *A Model for the Prediction of Thresholds, Loudness and Partial Loudness*, in J. Audio Eng. Soc., 45 (1997) ("MG1997") and the corresponding discussion, which are hereby incorporated by reference.

The spectrum of each audio object is banded into equivalent rectangular bands ERB that model the logarithmic spacing with frequency along the basilar membrane via a filterbank, and the energy out of these filters is smoothed to give the excitation $E_i(b)$, where b indexes over the ERB.

In some examples, the nonlinear compression from excitation $E_i(b)$ to specific loudness $N_i(b)$ may be calculated via the following equation:

$$N_i(b)=C[[G(b)E_i(b)+A(b)]^{\alpha}-A(b)^{\alpha}]. \quad \text{(Equation 5)}$$

In Equation 5, A, G and a represent an interdependent function of b. For example, G may be matched to experimental data and then the corresponding a and A values can be calculated. Some examples are provided in FIGS. 2, 3 and 4 of MG2004 and the corresponding discussion, which are hereby incorporated by reference.

The value at levels close to the absolute threshold of hearing in a quiet environment actually falls off more quickly than Equation 5 suggests. (It is not necessarily zero because even though a tone at a single frequency may be inaudible if a sound is wideband, the combination of inaudible tones can be audible.) A correction factor of $[2E(b)/(E(b)+E_{THRQ}(b))]^{1.5}$ may be applied when $E(b)<E_{THRQ}(b)$. An example of $E_{THRQ}(b)$ is given in FIG. 2 of MG2004 and $G\cdot E_{THRQ}$=const. The model can also be made more accurate at very high levels of excitation $E_i>10^{10}$ by using the alternative equation $$Ni(b)=C(Ei(b)/1.115).$$

The perceived reference loudness may then calculated by summing the specific loudness over bands and ears, e.g., according to the following:

$$LR_i = 10\log_{10}\left[\sum_b (N_i leftear, b) + N_i(rightear, b)\right] \quad \text{(Equation 6)}$$

The reference loudness model is not yet complete because we should also incorporate the effects of the other audio objects present at the time. Even though environmental noise is not included for the reference model, the loudness of audio object i is calculated in the presence of audio objects j≠i. This is discussed in the next section.

Consider sounds with intermediate range audio, wherein $E_{THRN}<(E_i+E_n)<10^{10}$, where we use $$E_n = \sum_{j\neq i} g_j(b)E_j + E_0$$

to represent the excitation from all other background audio objects including environmental noise, and the absolute threshold noise may be represented as $E_{THRN}=KE_{noise}+E_{THRQ}$, where K is a function of frequency found in FIG. 9 of MG1997 and the corresponding discussion, which is hereby incorporated by reference. In this situation, the total specific loudness $N_t$ of will be $$N_t=C[(E_i+E_n)G+A]^{\alpha}-A^{\alpha}]. \quad \text{(Equation 7)}$$

Some of this loudness will be perceived as coming from the audio object i. It will be assumed that $N_t=N_i+N_n$. $N_t$ may be partitioned between $N_i$ and $N_n$, e.g., as described in the examples provided in MG1997 (which are hereby incorporated by reference), giving:

$$N_i = C[(E_i + E_n)G + A]^{\alpha} - A^{\alpha}] - C\{[(E_n(1 + K) + E_{THRQ})G + A]^{\alpha} - (E_{THRQ}G + A)^{\alpha}\}\left(\frac{E_{THRN}}{E_i}\right)^{0.3}$$

When $E_i<E\ T_{THRN}$ we may use an alternative equation:

$$N_i = C\left(\frac{2E_i}{E_i + E_n}\right)^{1.5}\left\{\frac{(E_{THRQ}G + A)^{\alpha} - A^{\alpha}}{[(E_n(1 + K) + E_{THRQ})G + A]^{\alpha} - (E_nG + A)^{\alpha}}\right\}\cdot \{[(E_i + E_n)G + A]^{\alpha} - (E_nG + A)^{\alpha}\}$$

More accurate equations for situations in which $E_i+E_n>10^{10}$, such as equations 19 and 20 of MG1997, which are hereby incorporated by reference.

The effects of hearing loss may include: (1) an elevation of the absolute threshold in quiet; (2) a reduction in (or loss of) the compressive non-linearity; (3) a loss of frequency selectivity and/or (4) "dead regions" in the cochlea, with no response at all. Some implementations disclosed herein address the first two effects by fitting a new value of G(b) to the hearing loss and recalculating the corresponding a and A values for this value. Some such methods may involve adding an attenuation to the excitation that may scale with the level above absolute threshold. Some implementations disclosed herein address the third effect by fitting a broadening factor to the calculation of the spectral bands, which in some implementations may be equivalent rectangular (ERB) bands. Some implementations disclosed herein address the fourth effect by setting $g_i(b)=0$, and $E_i(b)=0$ for the dead region. After the priority-based gain solver has then solved for the other gains with $g_i(b)=0$, this $g_i(b)$ may be replaced with a value that is close enough to its neighbors $g_i(b+1)$ and $g_i(b-1)$, so that the value does not cause distortions in the filterbank.

According to some examples, the foregoing effects of hearing loss may be addressed by extrapolating from an audiogram and assuming that the total hearing loss is divided into outer hearing loss and inner hearing loss. Some relevant examples are described in MG2004 and are hereby incorporated by reference. For example, Section 3.1 of MG2004 explains that one may obtain the total hearing loss for each band by interpolating this from the audiogram. A remaining problem is to distinguish outer hearing loss (OHL) from inner hearing loss (IHL). Setting OHL=0.9 THL provides a good solution to this problem in many instances.

Some implementations involve compensating for speaker deficiencies by applying a speaker transfer function to the $E_n$ when calculating $LHL_i$. In practice, however, below a certain frequency a speaker generally produces little energy and creates significant distortion. For these frequencies, some implementations involve setting $E_n(b)=0$ and $g_i(b)=0$.

Various modifications to the implementations described in this disclosure may be readily apparent to those having ordinary skill in the art. The general principles defined herein may be applied to other implementations without departing from the scope of this disclosure. Thus, the claims are not intended to be limited to the implementations shown herein, but are to be accorded the widest scope consistent with this disclosure, the principles and the novel features disclosed herein.

The invention claimed is:

1. A method, comprising:

receiving audio data comprising a plurality of audio objects, the audio objects including audio signals and associated audio object metadata, the audio object metadata including audio object position metadata;

receiving reproduction environment data comprising an indication of a number of reproduction speakers in a reproduction environment;

determining at least one audio object type from among a list of audio object types that includes dialogue;

making an audio object prioritization based, at least in part, on the audio object type, wherein making the audio object prioritization involves assigning a highest priority to audio objects that correspond to the dialogue;

adjusting audio object levels according to the audio object prioritization; and rendering the audio objects into a plurality of speaker feed signals based, at least in part, on the audio object position metadata, wherein each speaker feed signal corresponds to at least one of the reproduction speakers within the reproduction environment, wherein rendering involves rendering the audio objects to locations in a virtual acoustic space and increasing a distance between at least some audio objects in the virtual acoustic space.

2. The method of claim 1, further comprising receiving hearing environment data comprising at least one factor selected from a group of factors consisting of: a model of hearing loss; a deficiency of at least one reproduction speaker; and current environmental noise, wherein adjusting the audio object levels is based, at least in part, on the hearing environment data.

3. The method of claim 1, wherein the virtual acoustic space includes a front area and a back area and wherein the rendering involves increasing a distance between at least some audio objects in the front area of the virtual acoustic space.

4. The method of claim 3, wherein the virtual acoustic space is represented by spherical harmonics, and the method comprises increasing the angular separation between at least some audio objects in the front area of the virtual acoustic space prior to rendering.

5. The method of claim 1, wherein the rendering involves rendering the audio objects according to a plurality of virtual speaker locations within the virtual acoustic space.

6. The method of claim 1, wherein the audio object metadata includes metadata indicating audio object size and wherein making the audio object prioritization involves applying a function that reduces a priority of non-dialogue audio objects according to increases in audio object size.

7. The method of claim 1, further comprising:

determining that an audio object has audio signals that include a directional component and a diffuse component; and reducing a level of the diffuse component.

8. A method, comprising:

receiving audio data comprising a plurality of audio objects, the audio objects including audio signals and associated audio object metadata;

extracting one or more features from the audio data;

determining an audio object type based, at least in part, on features extracted from the audio signals, wherein the audio object type is selected from a list of audio object types that includes dialogue;

making an audio object prioritization based, at least in part, on the audio object type, wherein the audio object prioritization determines, at least in part, a gain to be applied during a process of rendering the audio objects into speaker feed signals, the process of rendering involving rendering the audio objects to locations in a virtual acoustic space, and wherein making the audio object prioritization involves assigning a highest priority to audio objects that correspond to the dialogue;

adding audio object prioritization metadata, based on the audio object prioritization, to the audio object metadata; and increasing a distance between at least some audio object in the virtual acoustic space.

9. The method of claim 8, wherein the one or more features include at least one feature from a list of features consisting of: spectral flux; loudness; audio object size; entropy-related features; harmonicity features; spectral envelope features; phase features; and temporal features.

10. The method of claim 8, further comprising:

determining a confidence score regarding each audio object type determination; and applying a weight to each confidence score to produce a weighted confidence score, the weight corresponding to the audio object type determination, wherein making an audio object prioritization is based, at least in part, on the weighted confidence score.

11. The method of claim 8, further comprising:

receiving hearing environment data comprising a model of hearing loss;

adjusting audio object levels according to the audio object prioritization and the hearing environment data; and rendering the audio objects into a plurality of speaker feed signals based, at least in part, on the audio object position metadata, wherein each speaker feed signal corresponds to at least one of the reproduction speakers within the reproduction environment.

12. The method of claim 8, wherein the audio object metadata includes audio object size metadata and wherein the audio object position metadata indicates locations in a virtual acoustic space, further comprising:

receiving hearing environment data comprising a model of hearing loss;

receiving indications of a plurality of virtual speaker locations within the virtual acoustic space;

adjusting audio object levels according to the audio object prioritization and the hearing environment data; and rendering the audio objects to the plurality of virtual speaker locations within the virtual acoustic space based, at least in part, on the audio object position metadata and the audio object size metadata.

13. An apparatus, comprising:

an interface system capable of receiving audio data comprising a plurality of audio objects, the audio objects including audio signals and associated audio object metadata, the audio object metadata including at least audio object position metadata; and a control system configured for:

receiving reproduction environment data comprising an indication of a number of reproduction speakers in a reproduction environment;

determining at least one audio object type from among a list of audio object types that includes dialogue;

making an audio object prioritization based, at least in part, on the audio object type, wherein making the audio object prioritization involves assigning a highest priority to audio objects that correspond to the dialogue;

adjusting audio object levels according to the audio object prioritization; and rendering the audio objects into a plurality of speaker feed signals based, at least in part, on the audio object position metadata, wherein each speaker feed signal corresponds to at least one of the reproduction speakers within the reproduction environment, wherein rendering involves rendering the audio objects to locations in a virtual acoustic space, and increasing a distance between at least some audio objects in the virtual acoustic space.

14. A non-transitory medium having software stored thereon, the software including instructions for controlling at least one device for:

receiving audio data comprising a plurality of audio objects, the audio objects including audio signals and associated audio object metadata, the audio object metadata including at least audio object position metadata;

receiving reproduction environment data comprising an indication of a number of reproduction speakers in a reproduction environment;

determining at least one audio object type from among a list of audio object types that includes dialogue;

making an audio object prioritization based, at least in part, on the audio object type, wherein making the audio object prioritization involves assigning a highest priority to audio objects that correspond to the dialogue;

adjusting audio object levels according to the audio object prioritization; and rendering the audio objects into a plurality of speaker feed signals based, at least in part, on the audio object position metadata, wherein each speaker feed signal corresponds to at least one of the reproduction speakers within the reproduction environment, wherein rendering involves rendering the audio objects to locations in a virtual acoustic space and increasing a distance between at least some audio objects in the virtual acoustic space.

15. An apparatus, comprising:

an interface system capable of receiving audio data comprising a plurality of audio objects, the audio objects including audio signals and associated audio object metadata; and a control system configured for:

extracting one or more features from the audio data;

determining an audio object type based, at least in part, on features extracted from the audio signals, wherein the audio object type is selected from a list of audio object types that includes dialogue;

making an audio object prioritization based, at least in part, on the audio object type, wherein the audio object prioritization determines, at least in part, a gain to be applied during a process of rendering the audio objects into speaker feed signals, the process of rendering involving rendering the audio objects to locations in a virtual acoustic space, and wherein making the audio object prioritization involves assigning a highest priority to audio objects that correspond to the dialogue;

adding audio object prioritization metadata, based on the audio object prioritization, to the audio object metadata; and increasing a distance between at least some audio objects in the virtual acoustic space.

* * * * *